US006691680B2

(12) United States Patent
Saito

(10) Patent No.: US 6,691,680 B2
(45) Date of Patent: Feb. 17, 2004

(54) CONTROL SYSTEM FOR MARINE ENGINE

(75) Inventor: Chitoshi Saito, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/266,105

(22) Filed: Oct. 4, 2002

(65) Prior Publication Data

US 2003/0075150 A1 Apr. 24, 2003

(30) Foreign Application Priority Data

Oct. 4, 2001 (JP) ..... 2001-308553

(51) Int. Cl.[7] ..... F02D 9/00

(52) U.S. Cl. ..... 123/399; 123/400; 123/478

(58) Field of Search ..... 123/399, 395, 123/400, 478

(56) References Cited

U.S. PATENT DOCUMENTS

| | | | | |
|---|---|---|---|---|
| 4,998,521 | A | 3/1991 | Inoue et al. | |
| 5,060,617 | A | 10/1991 | Kojima et al. | |
| 5,184,589 | A | 2/1993 | Nonaka | |
| 5,215,068 | A | 6/1993 | Kato | |
| 5,450,830 | A | 9/1995 | Katoh | |
| 5,579,745 | A | 12/1996 | Katoh et al. | |
| 5,586,524 | A | 12/1996 | Nonaka et al. | |
| 5,626,120 | A | 5/1997 | Akatsuka | |
| 5,632,260 | A | 5/1997 | Kato | |
| 5,687,700 | A | 11/1997 | Kato | |
| 5,727,536 | A | 3/1998 | Kato | |
| 5,769,053 | A | 6/1998 | Nonaka | |
| 5,775,311 | A | 7/1998 | Kato et al. | |
| 5,806,496 | A | 9/1998 | Saito | |
| 5,813,390 | A | 9/1998 | Anamoto | |
| 5,941,223 | A | 8/1999 | Kato | |
| 6,030,261 | A | 2/2000 | Motose | |
| 6,039,012 | A | 3/2000 | Motoyama | |
| 6,065,445 | A | 5/2000 | Motose et al. | |
| 6,116,228 | A | 9/2000 | Motose et al. | |
| 6,276,341 | B1 * | 8/2001 | Takahashi et al. | 123/492 |
| 6,325,046 | B1 | 12/2001 | Kanno | |

OTHER PUBLICATIONS

Co–pending patent application No. 09/583,347 filed May 31, 2000 in the name of Motose et al. entitled Oxygen Sensor and Feedback System For Outboard Motor Engine.

Co–pending patent application No. 09/705,157 filed Nov. 2, 2000 in the name of Kanno entitled Fuel Injection Control For Engine.

Co–pending patent application No. 09/704,015 filed Nov. 1, 2000 in the name of Kanno entitled Fuel Injection Control System For Marine Engines.

Co–pending patent application No. 09/708,900 filed Nov. 8, 2000 in the name of Kanno entitled Marine Engine Control System.

* cited by examiner

*Primary Examiner*—Bibhu Mohanty
(74) *Attorney, Agent, or Firm*—Knobbe, Martens, Olson & Bear, LLP.

(57) ABSTRACT

A marine engine has an air intake device that includes an air regulator (e.g., a throttle valve) and fuel injectors. A control system controls an actuator of the air regulator. A first sensor detects an intake pressure in the intake device. A second sensor detects a state of the actuator. A third sensor detects an engine speed of the engine. A control device controls an amount of fuel sprayed by the fuel injectors relative to an amount of the intake air. The control device controls the amount of the fuel based upon a signal of the third sensor and a signal of the first sensor in a first actuation range of the actuator in which the intake pressure is variable. The control device controls the amount of the fuel based upon a signal of the third sensor and a signal of the second sensor in a second actuation range of the actuator in which the intake pressure is invariable.

44 Claims, 14 Drawing Sheets

Injection Duration Maps

D1

| Engine Speed \ Intake Pressure | 26.7 | 32 | 40 | 50 | 60 | 70 |
|---|---|---|---|---|---|---|
| 600 | 176 | 210 | 270 | 350 | 426 | 480 |
| 900 | 181 | 229 | 290 | 361 | 430 | 495 |
| 1100 | 190 | 244 | | | | |
| 1500 | 203 | 245 | | | | |
| 2000 | 205 | | | | | |
| 2500 | 208 | | | | | |
| 3000 | | | | | | |
| 3500 | | | | | | |
| 4000 | | | | | | |
| 4500 | | | | | | |
| 5000 | | | | | | |
| 5500 | | | | | | |
| 6000 | | | | | | |
| 6500 | | | | | | |

Throttle Position

| Engine Speed \ Throttle Position | 30 | 35 | 40 | 45 |
|---|---|---|---|---|
| 600 | 0 | 34 | 69 | 104 |
| 900 | 0 | 34 | 69 | 104 |
| 1100 | 0 | 34 | 69 | 104 |
| 1500 | 0 | 34 | 69 | 104 |
| 2000 | 0 | 0 | 25 | 56 |
| 2500 | 0 | 0 | 0 | 22 |
| 3000 | 0 | 0 | 0 | 0 |
| 3500 | 0 | 0 | 0 | 0 |
| 4000 | 0 | 0 | 0 | 0 |
| 4500 | 0 | 0 | 0 | 0 |
| 5000 | 0 | 0 | 0 | 0 |
| 5500 | 0 | 0 | 0 | 0 |
| 6000 | 0 | 0 | 0 | 0 |
| 6500 | 0 | 0 | 0 | 0 |

D2

*Figure 5 (a)*

Ignition Timing Maps

F1

| Engine Speed \ Intake Pressure | 26.7 | 32 | 40 | 50 | 60 | 70 | 80 |
|---|---|---|---|---|---|---|---|
| 600 | 32 | 41 | 50 | 58 | 58 | 56 | 56 |
| 900 | 32 | 41 | 50 | 58 | 58 | 56 | 56 |
| 1100 | 32 | 41 | 50 | | | | |
| 1500 | 32 | 41 | 50 | | | | |
| 2000 | 32 | 41 | 50 | | | | |
| 2500 | 34 | 4 | | | | | |
| 3000 | 38 | 4 | | | | | |
| 3500 | | | | | | | |
| 4000 | | | | | | | |
| 4500 | | | | | | | |
| 5000 | | | | | | | |
| 5500 | | | | | | | |
| 6000 | | | | | | | |
| 6500 | | | | | | | |

Throttle Position

| Engine Speed \ Throttle Position | 30 | 35 | 40 | 45 |
|---|---|---|---|---|
| 600 | 0 | 0 | -11 | -17 |
| 900 | 0 | 0 | -11 | -17 |
| 1100 | 0 | 0 | -11 | -17 |
| 1500 | 0 | 0 | -11 | -17 |
| 2000 | 0 | 0 | -11 | -17 |
| 2500 | 0 | 0 | 0 | -14 |
| 3000 | 0 | 0 | 0 | 0 |
| 3500 | 0 | 0 | 0 | 0 |
| 4000 | 0 | 0 | 0 | 0 |
| 4500 | 0 | 0 | 0 | 0 |
| 5000 | 0 | 0 | 0 | 0 |
| 5500 | 0 | 0 | 0 | 0 |
| 6000 | 0 | 0 | 0 | 0 |
| 6500 | 0 | 0 | 0 | 0 |

F2

*Figure 5 (b)*

Target Air-Fuel Ratio Maps

T1

| Engine Speed \ Intake Pressure | 26.7 | 32 | 40 | 50 | 60 | 70 | 80 |
|---|---|---|---|---|---|---|---|
| 600 | 143 | 143 | 153 | 174 | 181 | 191 | 200 |
| 900 | 143 | 143 | 154 | 174 | 181 | 191 | 200 |
| 1100 | 143 | 143 | 155 | | | | |
| 1500 | 143 | 143 | 170 | | | | |
| 2000 | 143 | 143 | 172 | | | | |
| 2500 | 141 | 14 | | | | | |
| 3000 | 142 | 14 | | | | | |
| 3500 | 1 | | | | | | |
| 4000 | 1 | | | | | | |
| 4500 | 1 | | | | | | |
| 5000 | 1 | | | | | | |
| 5500 | 1 | | | | | | |
| 6000 | 1 | | | | | | |
| 6500 | 1 | | | | | | |

Throttle Position

| Engine Speed \ Throttle Position | 30 | 35 | 40 | 45 |
|---|---|---|---|---|
| 600 | 0 | 0 | -3 | -13 |
| 900 | 0 | 0 | -3 | -13 |
| 1100 | 0 | 0 | -8 | -13 |
| 1500 | 0 | 0 | -9 | -18 |
| 2000 | 0 | 0 | -9 | -16 |
| 2500 | 0 | 0 | 0 | -9 |
| 3000 | 0 | 0 | 0 | 0 |
| 3500 | 0 | 0 | 0 | 0 |
| 4000 | 0 | 0 | 0 | 0 |
| 4500 | 0 | 0 | 0 | 0 |
| 5000 | 0 | 0 | 0 | 0 |
| 5500 | 0 | 0 | 0 | 0 |
| 6000 | 0 | 0 | 0 | 0 |
| 6500 | 0 | 0 | 0 | 0 |

T2

*Figure 5 (c)*

Intake Pressure

| Engine Speed | 28.7 | 32 | 40 | 50 | 60 | 70 | 80 | 88 | 93 | 98 | 100 |
|---|---|---|---|---|---|---|---|---|---|---|---|
| 600 | 175 | 210 | 270 | 350 | | | | 560 | 580 | 610 | 630 |
| 900 | 181 | 229 | 290 | 361 | | | | 578 | 605 | 630 | 653 |
| 1100 | 190 | 244 | 315 | 382 | Main Map | | | 589 | 615 | 650 | 664 |
| 1500 | 203 | 245 | 310 | 380 | | | | 597 | 629 | 660 | 675 |
| 2000 | 205 | 246 | 304 | 362 | 422 | 475 | 523 | 580 | 615 | 650 | 663 |
| 2500 | 208 | 228 | 270 | 332 | 394 | 448 | 497 | 554 | 589 | 636 | 647 |
| 3000 | 197 | 244 | 283 | 340 | 400 | 452 | 508 | 565 | 608 | 649 | 668 |
| 3500 | 216 | 284 | 327 | 392 | 461 | 519 | 573 | 627 | 663 | 701 | 721 |
| 4000 | 228 | 286 | 334 | 402 | 462 | 519 | 578 | 640 | 675 | 707 | 734 |
| 4500 | 234 | 296 | 344 | 409 | 476 | 537 | 595 | 653 | 702 | 740 | 761 |
| 5000 | 225 | 299 | 347 | 420 | 486 | 547 | 608 | 681 | 732 | 780 | 794 |
| 5500 | 220 | 263 | 313 | 376 | 442 | 501 | 557 | 633 | 677 | 736 | 731 |
| 6000 | 225 | 246 | 294 | 361 | 428 | 485 | 573 | 644 | 681 | 713 | 721 |
| 6500 | 260 | 284 | 302 | 375 | 443 | 499 | 573 | 642 | 662 | 699 | 715 |

D1

Exemplary
Injection Duration
Calculation

E/Grev.: 4000rpm
Boost: 100kPa
Th $\theta$: 70°

Injection Duration = (734 + 206) x 10 = 9400 ($\mu$ sec)

Throttle Position

| Engine Speed | 30 | 35 | 40 | 45 | 50 | 55 | 60 | 65 | 70 | 75 | 80 |
|---|---|---|---|---|---|---|---|---|---|---|---|
| 600 | 0 | 34 | 69 | 104 | 138 | 173 | 207 | 242 | 276 | 311 | 345 |
| 900 | 0 | 34 | 69 | 104 | | | | 242 | 276 | 311 | 345 |
| 1100 | 0 | 34 | 69 | 104 | Adjustment Map | | | 242 | 276 | 311 | 345 |
| 1500 | 0 | 34 | 69 | 104 | | | | 242 | 276 | 311 | 345 |
| 2000 | 0 | 0 | 25 | 56 | 90 | 119 | 168 | 203 | 254 | 311 | 386 |
| 2500 | 0 | 0 | 0 | 22 | 51 | 86 | 134 | 185 | 245 | 318 | 417 |
| 3000 | 0 | 0 | 0 | 0 | 19 | 53 | 98 | 155 | 216 | 287 | 406 |
| 3500 | 0 | 0 | 0 | 0 | 0 | 42 | 96 | 143 | 212 | 309 | 397 |
| 4000 | 0 | 0 | 0 | 0 | 0 | 0 | 51 | 127 | 206 | 300 | 455 |
| 4500 | 0 | 0 | 0 | 0 | 0 | 0 | 56 | 125 | 207 | 309 | 464 |
| 5000 | 0 | 0 | 0 | 0 | 0 | 0 | 59 | 132 | 223 | 320 | 465 |
| 5500 | 0 | 0 | 0 | 0 | 0 | 0 | 65 | 131 | 213 | 310 | 454 |
| 6000 | 0 | 0 | 0 | 0 | 0 | 0 | 66 | 133 | 199 | 266 | 332 |
| 6500 | 0 | 0 | 0 | 0 | 0 | 0 | 66 | 133 | 199 | 266 | 332 |

D2

*Figure 6*

Injection Duration Maps
Intake Pressure

D1

| Engine Speed | 26.7 | 32 | 40 | 50 | 60 | 70 |
|---|---|---|---|---|---|---|
| 600 | 176 | 210 | 270 | 350 | 426 | 480 |
| 900 | 181 | 229 | 290 | 361 | 430 | 495 |
| 1100 | 190 | 244 | | | | |
| 1500 | 203 | 245 | | | | |
| 2000 | 205 | | | | | |
| 2500 | 208 | | | | | |

Cam Position

| Engine Speed | 30 | 35 | 40 | 45 |
|---|---|---|---|---|
| 600 | 0 | 34 | 69 | 104 |
| 900 | 0 | 34 | 69 | 104 |
| 1100 | 0 | 34 | 69 | 104 |
| 1500 | 0 | 34 | 69 | 104 |
| 2000 | 0 | 0 | 25 | 56 |
| 2500 | 0 | 0 | 0 | 22 |
| 3000 | 0 | 0 | 0 | 0 |
| 3500 | 0 | 0 | 0 | 0 |
| 4000 | 0 | 0 | 0 | 0 |
| 4500 | 0 | 0 | 0 | 0 |
| 5000 | 0 | 0 | 0 | 0 |
| 5500 | 0 | 0 | 0 | 0 |
| 6000 | 0 | 0 | 0 | 0 |
| 6500 | 0 | 0 | 0 | 0 |

D2

*Figure 10 (a)*

Ignition Timing Maps
Intake Pressure

F1

| Engine Speed | 26.7 | 32 | 40 | 50 | 60 | 70 | 80 |
|---|---|---|---|---|---|---|---|
| 600 | 32 | 41 | 50 | 58 | 58 | 56 | 56 |
| 900 | 32 | 41 | 50 | 58 | 58 | 56 | 56 |
| 1100 | 32 | 41 | 50 | | | | |
| 1500 | 32 | 41 | 50 | | | | |
| 2000 | 32 | 41 | 50 | | | | |
| 2500 | 34 | 4 | | | | | |
| 3000 | 38 | 4 | | | | | |
| 3500 | | | | | | | |
| 4000 | | | | | | | |
| 4500 | | | | | | | |
| 5000 | | | | | | | |
| 5500 | | | | | | | |
| 6000 | | | | | | | |
| 6500 | | | | | | | |

Cam Position

| Engine Speed | 30 | 35 | 40 | 45 |
|---|---|---|---|---|
| 600 | 0 | 0 | -11 | -17 |
| 900 | 0 | 0 | -11 | -17 |
| 1100 | 0 | 0 | -11 | -17 |
| 1500 | 0 | 0 | -11 | -17 |
| 2000 | 0 | 0 | -11 | -17 |
| 2500 | 0 | 0 | 0 | -14 |
| 3000 | 0 | 0 | 0 | 0 |
| 3500 | 0 | 0 | 0 | 0 |
| 4000 | 0 | 0 | 0 | 0 |
| 4500 | 0 | 0 | 0 | 0 |
| 5000 | 0 | 0 | 0 | 0 |
| 5500 | 0 | 0 | 0 | 0 |
| 6000 | 0 | 0 | 0 | 0 |
| 6500 | 0 | 0 | 0 | 0 |

F2

*Figure 10 (b)*

Target Air-Fuel Ration Maps
Intake Pressure

T1

| Engine Speed | 26.7 | 32 | 40 | 50 | 60 | 70 | 80 |
|---|---|---|---|---|---|---|---|
| 600 | 143 | 143 | 153 | 174 | 181 | 191 | 200 |
| 900 | 143 | 143 | 154 | 174 | 181 | 191 | 200 |
| 1100 | 143 | 143 | 155 | | | | |
| 1500 | 143 | 143 | 170 | | | | |
| 2000 | 143 | 143 | 172 | | | | |
| 2500 | 141 | 14 | | | | | |
| 3000 | 142 | 14 | | | | | |
| 3500 | 1 | | | | | | |
| 4000 | 1 | | | | | | |
| 4500 | 1 | | | | | | |
| 5000 | 1 | | | | | | |
| 5500 | 1 | | | | | | |
| 6000 | 1 | | | | | | |
| 6500 | 1 | | | | | | |

Cam Position

| Engine Speed | 30 | 35 | 40 | 45 |
|---|---|---|---|---|
| 600 | 0 | 0 | -3 | -13 |
| 900 | 0 | 0 | -3 | -13 |
| 1100 | 0 | 0 | -8 | -13 |
| 1500 | 0 | 0 | -9 | -18 |
| 2000 | 0 | 0 | -9 | -16 |
| 2500 | 0 | 0 | 0 | -9 |
| 3000 | 0 | 0 | 0 | 0 |
| 3500 | 0 | 0 | 0 | 0 |
| 4000 | 0 | 0 | 0 | 0 |
| 4500 | 0 | 0 | 0 | 0 |
| 5000 | 0 | 0 | 0 | 0 |
| 5500 | 0 | 0 | 0 | 0 |
| 6000 | 0 | 0 | 0 | 0 |
| 6500 | 0 | 0 | 0 | 0 |

T2

*Figure 10 (c)*

Injection Duration Maps
Intake Pressure

D1

| Engine Speed | 26.7 | 32 | 40 | 50 | 60 | 70 |
|---|---|---|---|---|---|---|
| 600 | 176 | 210 | 270 | 350 | 426 | 480 |
| 900 | 181 | 229 | 290 | 361 | 430 | 495 |
| 1100 | 190 | 244 | | | | |
| 1500 | 203 | 245 | | | | |
| 2000 | 205 | | | | | |
| 2500 | 208 | | | | | |
| 3000 | | | | | | |
| 3500 | | | | | | |
| 4000 | | | | | | |
| 4500 | | | | | | |
| 5000 | | | | | | |
| 5500 | | | | | | |
| 6000 | | | | | | |
| 6500 | | | | | | |

Lever Position

| Engine Speed | 30 | 35 | 40 | 45 |
|---|---|---|---|---|
| 600 | 0 | 34 | 69 | 104 |
| 900 | 0 | 34 | 69 | 104 |
| 1100 | 0 | 34 | 69 | 104 |
| 1500 | 0 | 34 | 69 | 104 |
| 2000 | 0 | 0 | 25 | 56 |
| 2500 | 0 | 0 | 0 | 22 |
| 3000 | 0 | 0 | 0 | 0 |
| 3500 | 0 | 0 | 0 | 0 |
| 4000 | 0 | 0 | 0 | 0 |
| 4500 | 0 | 0 | 0 | 0 |
| 5000 | 0 | 0 | 0 | 0 |
| 5500 | 0 | 0 | 0 | 0 |
| 6000 | 0 | 0 | 0 | 0 |
| 6500 | 0 | 0 | 0 | 0 |

D2

*Figure 14 (a)*

Ignition Timing Maps
Intake Pressure

F1

| Engine Speed | 26.7 | 32 | 40 | 50 | 60 | 70 | 80 |
|---|---|---|---|---|---|---|---|
| 600 | 32 | 41 | 50 | 58 | 58 | 56 | 56 |
| 900 | 32 | 41 | 50 | 58 | 58 | 56 | 56 |
| 1100 | 32 | 41 | 50 | | | | |
| 1500 | 32 | 41 | 50 | | | | |
| 2000 | 32 | 41 | 50 | | | | |
| 2500 | 34 | 41 | | | | | |
| 3000 | 38 | | | | | | |
| 3500 | | | | | | | |
| 4000 | | | | | | | |
| 4500 | | | | | | | |
| 5000 | | | | | | | |
| 5500 | | | | | | | |
| 6000 | | | | | | | |
| 6500 | | | | | | | |

Lever Position

| Engine Speed | 30 | 35 | 40 | 45 |
|---|---|---|---|---|
| 600 | 0 | 0 | -11 | -17 |
| 900 | 0 | 0 | -11 | -17 |
| 1100 | 0 | 0 | -11 | -17 |
| 1500 | 0 | 0 | -11 | -17 |
| 2000 | 0 | 0 | -11 | -17 |
| 2500 | 0 | 0 | 0 | -14 |
| 3000 | 0 | 0 | 0 | 0 |
| 3500 | 0 | 0 | 0 | 0 |
| 4000 | 0 | 0 | 0 | 0 |
| 4500 | 0 | 0 | 0 | 0 |
| 5000 | 0 | 0 | 0 | 0 |
| 5500 | 0 | 0 | 0 | 0 |
| 6000 | 0 | 0 | 0 | 0 |
| 6500 | 0 | 0 | 0 | 0 |

F2

*Figure 14 (b)*

Target Air-Fuel Ratio Maps
Intake Pressure

T1

| Engine Speed | 26.7 | 32 | 40 | 50 | 60 | 70 | 80 |
|---|---|---|---|---|---|---|---|
| 600 | 143 | 143 | 153 | 174 | 181 | 191 | 200 |
| 900 | 143 | 143 | 154 | 174 | 181 | 191 | 200 |
| 1100 | 143 | 143 | 155 | | | | |
| 1500 | 143 | 143 | 170 | | | | |
| 2000 | 143 | 143 | 172 | | | | |
| 2500 | 141 | 14 | | | | | |
| 3000 | 142 | 14 | | | | | |
| 3500 | 1 | | | | | | |
| 4000 | 1 | | | | | | |
| 4500 | 1 | | | | | | |
| 5000 | 1 | | | | | | |
| 5500 | 1 | | | | | | |
| 6000 | 1 | | | | | | |
| 6500 | 1 | | | | | | |

Lever Position

| Engine Speed | 30 | 35 | 40 | 45 |
|---|---|---|---|---|
| 600 | 0 | 0 | -3 | -13 |
| 900 | 0 | 0 | -3 | -13 |
| 1100 | 0 | 0 | -8 | -13 |
| 1500 | 0 | 0 | -9 | -18 |
| 2000 | 0 | 0 | -9 | -16 |
| 2500 | 0 | 0 | 0 | -9 |
| 3000 | 0 | 0 | 0 | 0 |
| 3500 | 0 | 0 | 0 | 0 |
| 4000 | 0 | 0 | 0 | 0 |
| 4500 | 0 | 0 | 0 | 0 |
| 5000 | 0 | 0 | 0 | 0 |
| 5500 | 0 | 0 | 0 | 0 |
| 6000 | 0 | 0 | 0 | 0 |
| 6500 | 0 | 0 | 0 | 0 |

T2

*Figure 14 (c)*

CONTROL SYSTEM FOR MARINE ENGINE

PRIORITY INFORMATION

This application is based on and claims priority to Japanese Patent Application No. 2001-308553, filed Oct. 4, 2001, the entire content of which is hereby expressly incorporated by reference herein.

BACKGROUND OF THE INVENTION

1. Field of the Invention

The present invention generally relates to a control system for a marine engine, and more particularly relates to an improved control system controlling a marine engine in response to signals from multiple sensors.

2. Description of Related Art

A marine drive, such as, for example, an outboard motor, drives a propulsion device such as, for example, a propellers, which is at least partly submerged when the watercraft on which it is installed is floating on a body of water. An engine used in a marine drive such as an outboard motor typically is either a two-cycle internal combustion engine or a four-cycle internal combustion engine.

An internal combustion engine for a marine drive typically has an intake device through which air is introduced into one or more combustion chambers. The air intake device typically incorporates a throttle valve or other mechanism to regulate an amount of air introduced into the combustion chambers during an intake portion of a cycle of the engine. The engine also employs a charge-forming device such as, for example, fuel injectors that spray fuel for combustion in the combustion chambers. As is well known, a ratio of the air amount relative to the fuel amount is called as an air-fuel ratio. The air-fuel ratio is one of the most significant values for control of the engine operation. Theoretically, a stoichiometric air-fuel ratio is selected as an ideal air-fuel ratio because, at this air-fuel ratio, the air-fuel charge or mixture can be completely burned in the combustion chambers.

In general, the engine can operate at an air-fuel ratio that varies from the stoichiometric air-fuel ratio by a limited amount. For example, an air-fuel ratio leaner than the stoichiometric air-fuel ratio may provide improved fuel economy. If, however, the air-fuel ratio of an engine operating at a stoichiometric air-fuel ratio is leaned, the output power (e.g., the torque) of the engine decreases. An engine for land vehicles is normally operated in a low speed range, in a low load range or in both low speed and low load ranges. Thus, a land vehicle engine is typically designed to operate at a lean air-fuel ratio under normal running conditions and to operate at the stoichiometric air-fuel ratio or at a richer air-fuel ratio when the engine load becomes high such as, for example, when the engine is accelerated to increase the speed of the land vehicle or to provide more output power.

On the other hand, unlike the land vehicle engine, a marine engine is normally or frequently operated at high speed, at high load or at high speed and high load. Since the fuel consumption of a land vehicle engine usually increases because of the use of the richer air-fuel ratio at high speeds and at high loads, control systems typically used by land vehicle engines are not practical for use with marine engines.

SUMMARY OF THE INVENTION

A need exists for a control system for a marine engine that can operate the engine at a lean air-fuel ratio as much as possible in a high speed range, a high load range or a combination of a high speed range and a high load range to decrease the fuel consumption of the marine engine.

One aspect of an embodiment in accordance with the present invention is an internal combustion engine for a marine drive that comprises an engine body. A first movable member (e.g., a piston) is movable relative to the engine body. The engine body and the movable member together define a combustion chamber. A second movable member is movable in response to movement of the first movable member. An air intake device introduces air to the combustion chamber. The air intake device incorporates an air regulation device (e.g., a throttle valve) that regulates an amount of the air. An actuator actuates the air regulation device. A fuel injector sprays fuel for combustion in the combustion chamber. A first sensor detects an intake pressure in the intake device. A second sensor is responsive to a state of the actuator or a state (e.g., a position) of the air regulation device. A third sensor is responsive to a speed of the second movable member. A control device controls an amount of the fuel relative to the amount of the air. The control device operates in first and second modes. In the first mode, the control device controls the amount of the fuel based upon a signal of the third sensor and a signal of the first sensor in a first operational range of the air regulation device in which the intake pressure is variable. In the second mode, the control device controls the amount of the fuel based upon the signal of the first sensor and a signal of the second sensor in a second operational range of the air regulation device in which the intake pressure is invariable.

Another aspect of an embodiment in accordance with the present invention is a control system for a marine engine. The engine has an air intake device to introduce air to a combustion chamber of the engine. The intake device incorporates an air regulator (e.g., a throttle valve) that regulates an amount of the air. A fuel injector sprays fuel for combustion in the combustion chamber. The control system comprises an actuator coupled to the air regulator. A first sensor detects an intake pressure in the intake device. A second sensor is responsive to a state of the actuator or a state (e.g., a position) of the air regulator. A third sensor is responsive to a speed of the engine. A control device controls an amount of the fuel relative to the amount of the air in two modes. In a first mode, the control device controls the amount of the fuel based upon a signal of the third sensor and a signal of the first sensor in a first operational range of the air regulator in which the intake pressure is variable. The control device controls the amount of the fuel based upon the signal of the first sensor and a signal of the second sensor in a second operational range of the air regulator in which the intake pressure is invariable.

A further aspect of an embodiment in accordance with the present invention is a control method for controlling a marine engine. The method comprises sensing an intake pressure of an air intake device, sensing a parameter responsive to a state (e.g., a position) of an air regulator of the intake device or a state of an actuator of the air regulator, sensing an engine speed of the engine, and controlling an amount of fuel injected by a fuel injector relative to an amount of air introduced through the intake device in first and second control modes. In the first control mode, the amount of fuel injected is controlled based upon the engine speed and the intake pressure in a first operational range of the air regulator in which the intake pressure is variable. In the second control mode, and the amount of the fuel injected is based upon the engine speed and the sensed parameter of the air regulator or actuator in a second operational range of the air regulation device in which the intake pressure is invariable.

Another aspect of an embodiment in accordance with the present invention is an engine control system for an internal combustion engine for a marine drive. The engine comprises at least one combustion chamber that receives air-fuel charges. The engine operates at a variable engine speed in response to ignition of the air-fuel charges. The engine further comprises an air intake device that introduces air to the combustion chamber. The air intake device incorporates an air regulator (e.g., a throttle valve) that regulates an amount of air introduced to the combustion chamber by the air intake device. A fuel injector introduces fuel to the combustion chamber. The engine control system comprises a first sensor that detects an intake pressure in the air intake device and generates a first sensor signal responsive to the intake pressure. A second sensor detects a state of the air regulator and generates a second sensor signal responsive to the state of the air regulator. A third sensor detects the engine speed and generates a third signal responsive to the engine speed. A control device operates in a first mode of operation when the intake pressure is varying to control an amount of fuel introduced by the fuel injector in response to the third sensor signal and the first sensor signal. The control device operates in a second mode of operation when the intake pressure is not varying to control the amount of fuel introduced by the fuel injector in response to the third sensor signal and the second sensor signal.

Another aspect of an embodiment in accordance with the present invention is an engine control system for an internal combustion engine for a marine drive. The engine comprises at least one combustion chamber that receives air-fuel charges. The engine operates at a variable engine speed in response to ignition of the air-fuel charges. The engine further comprises an air intake device that introduces air to the combustion chamber. The air intake device incorporates an air regulator (e.g., a throttle valve) that regulates an amount of air introduced to the combustion chamber by the air intake device. The air regulator has a variable state responsive to an actuator. A fuel injector introduces fuel to the combustion chamber. The engine control system comprises a first sensor that detects an intake pressure in the air intake device and generates a first sensor signal responsive to the intake pressure. A second sensor detects a state of the actuator of the air regulator and generates a second sensor signal responsive to the state of the actuator. A third sensor detects the engine speed and generates a third signal responsive to the engine speed. A control device operates in a first mode of operation when the intake pressure is varying to control an amount of fuel introduced by the fuel injector in response to the third sensor signal and the first sensor signal. The control device operates in a second mode of operation when the intake pressure is not varying to control the amount of fuel introduced by the fuel injector in response to the third sensor signal and the second sensor signal. In one embodiment in accordance with this aspect, the actuator is a cam that has a first surface at a variable distance from an axis of rotation and a second surface at a constant distance from the axis of rotation. The air regulator (e.g., the throttle valve) is coupled to the cam via a cam follower that follows the first surface during the first mode of operation and that follows the second surface during the second mode of operation. In another embodiment in accordance with this aspect, the actuator is a power control selector and the signal responsive to the state of the actuator is responsive to a power setting of the power control selector. The state of the air regulator (e.g., the position of the throttle valve) is responsive to changes in the power setting in the first mode of operation. The state of the air regulator is not responsive to changes in the power setting in the second mode of operation. Preferably, the air regulator in accordance with this embodiment is controlled by an electrical motor that operates to change the state of the air regulator (e.g., the position of the throttle valve) in response to changes in the power settings in the first mode of operation. The electrical motor maintains a constant state of the air regulator in the second mode of operation. In one particularly advantageous embodiment, the control device receives the signal responsive to the state of the actuator and generates control signals to the electrical motor to cause the electrical motor to change the state of the air regulator in response to the state of the actuator in the first mode of operation and generates control signals to the electrical motor to cause the electrical motor to maintain a substantially constant state of the air regulator in the second mode of operation.

BRIEF DESCRIPTION OF THE DRAWINGS

These and other features, aspects and advantages of preferred embodiments of the present invention will be described below with reference to the attached drawings, in which:

FIGS. 5(*a*), 5(*b*) and 5(*c*) illustrate control maps used by the control system, wherein FIG. 5(*a*) illustrates a main map of injection duration primary values indexed by combinations of engine speeds and air intake pressures and a correction map of injection duration adjustment values indexed by engine speeds and throttle valve positions; wherein FIG. 5(*b*) illustrates a main map of ignition timing primary values indexed by combinations of engine speeds and air intake pressures and a correction map of ignition timing adjustment values indexed by engine speeds and throttle valve positions; and wherein FIG. 5(*c*) illustrates a main map of target air-fuel ratio primary values indexed by combinations of engine speeds and air intake pressures and a correction map of target air-fuel ratio adjustment values indexed by engine speeds and throttle valve positions;

FIG. 6 illustrates an exemplary method of adjusting primary injection duration values from the main map of FIG. 5(*a*) by applying adjustment values from the correction map of FIG. 5(*a*);

FIGS. 10(*a*), 10(*b*) and 10(*c*) illustrate control maps used by the control system, wherein FIG. 10(*a*) illustrates a main map of injection duration primary values indexed by combinations of engine speeds and air intake pressures and a correction map of injection duration adjustment values indexed by engine speeds and cam angular positions; wherein FIG. 10(*b*) illustrates a main map of ignition timing primary values indexed by combinations of engine speeds and air intake pressures and a correction map of ignition timing adjustment values indexed by engine speeds and cam angular positions; and wherein FIG. 10(*c*) illustrates a main map of target air-fuel ratio primary values indexed by combinations of engine speeds and air intake pressures and a correction map of target air-fuel ratio adjustment values indexed by engine speeds and cam angular positions;

FIGS. 14(*a*), 14(*b*) and 14(*c*) illustrate control maps used by the control system, wherein FIG. 14(*a*) illustrates a main map of injection duration primary values indexed by combinations of engine speeds and air intake pressures and a correction map of injection duration adjustment values indexed by engine speeds and control lever positions; wherein FIG. 14(*b*) illustrates a main map of ignition timing primary values indexed by combinations of engine speeds and air intake pressures and a correction map of ignition timing adjustment values indexed by engine speeds and control lever positions; and wherein FIG. 14(*c*) illustrates a main map of target air-fuel ratio primary values indexed by combinations of engine speeds and air intake pressures and a correction map of target air-fuel ratio adjustment values indexed by engine speeds and control lever positions.

DETAILED DESCRIPTION OF THE PREFERRED EMBODIMENTS

Figure 1:
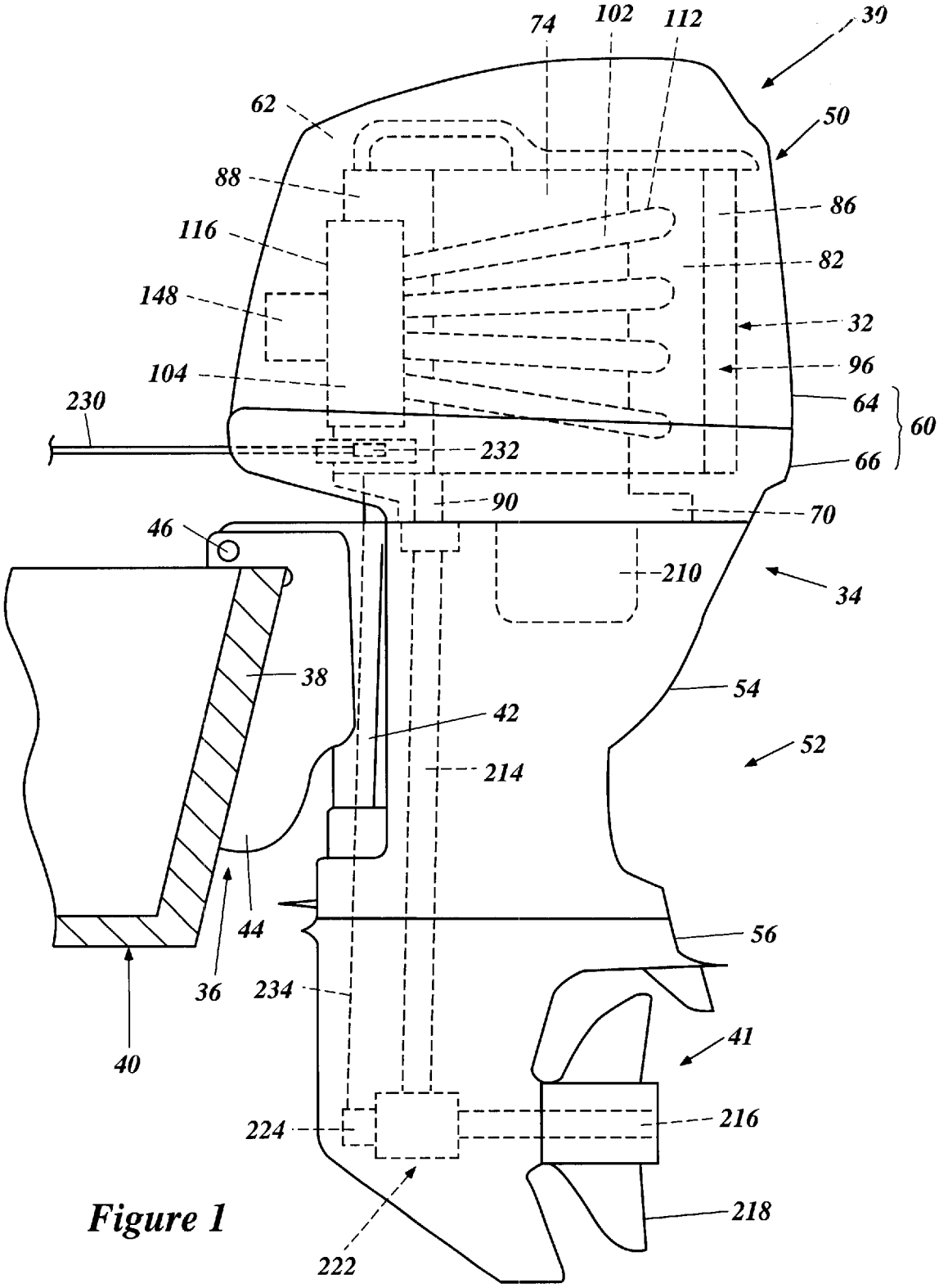
FIG. 1 is a side elevational view of an outboard motor that incorporates an engine which is controlled by a control system configured in accordance with a preferred embodiment of the present invention, wherein the outboard motor is mounted on a watercraft (shown in partial cross section)
Figure 2:
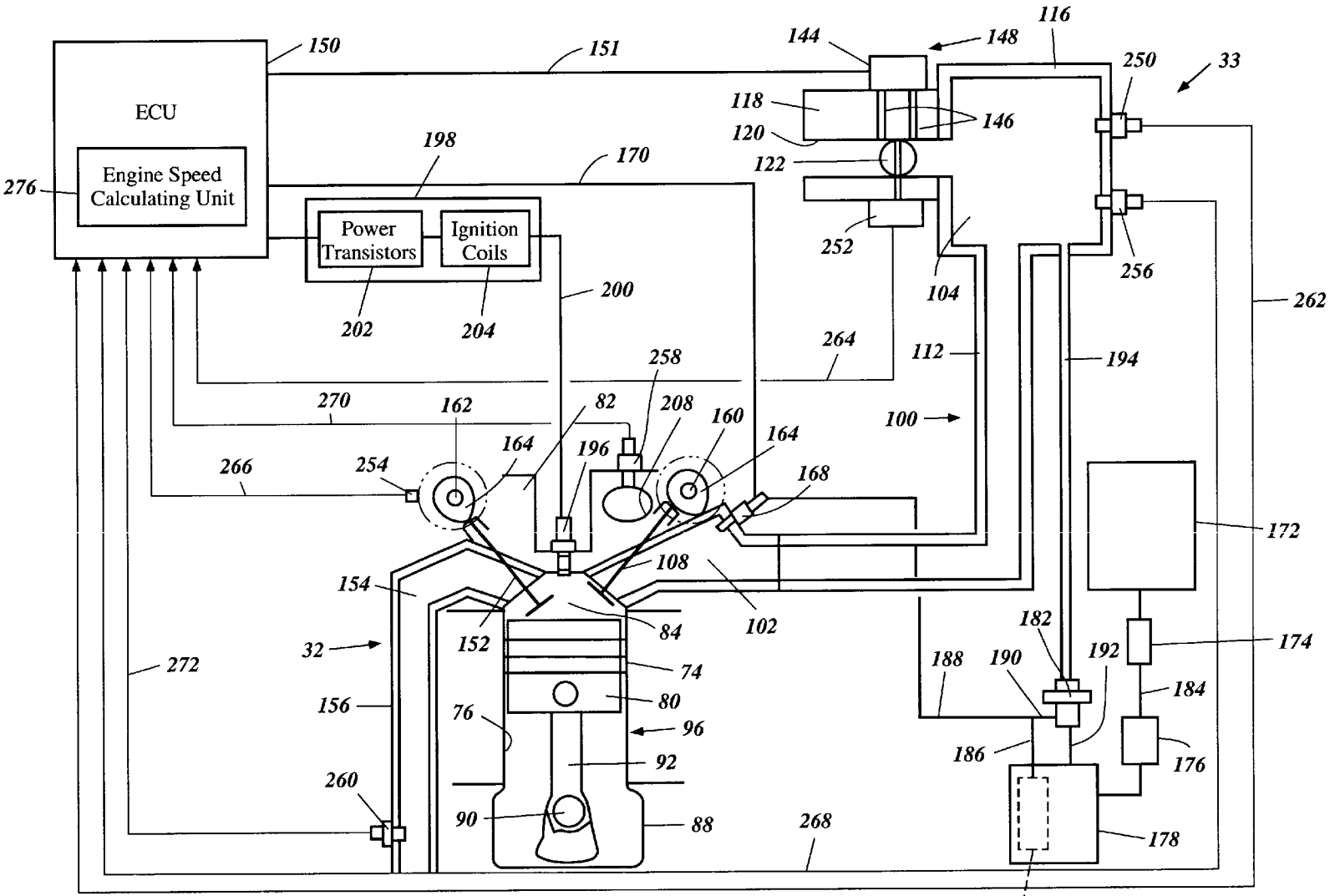
FIG. 2 is a schematic view of the control system.
Figures 3A, 3B:
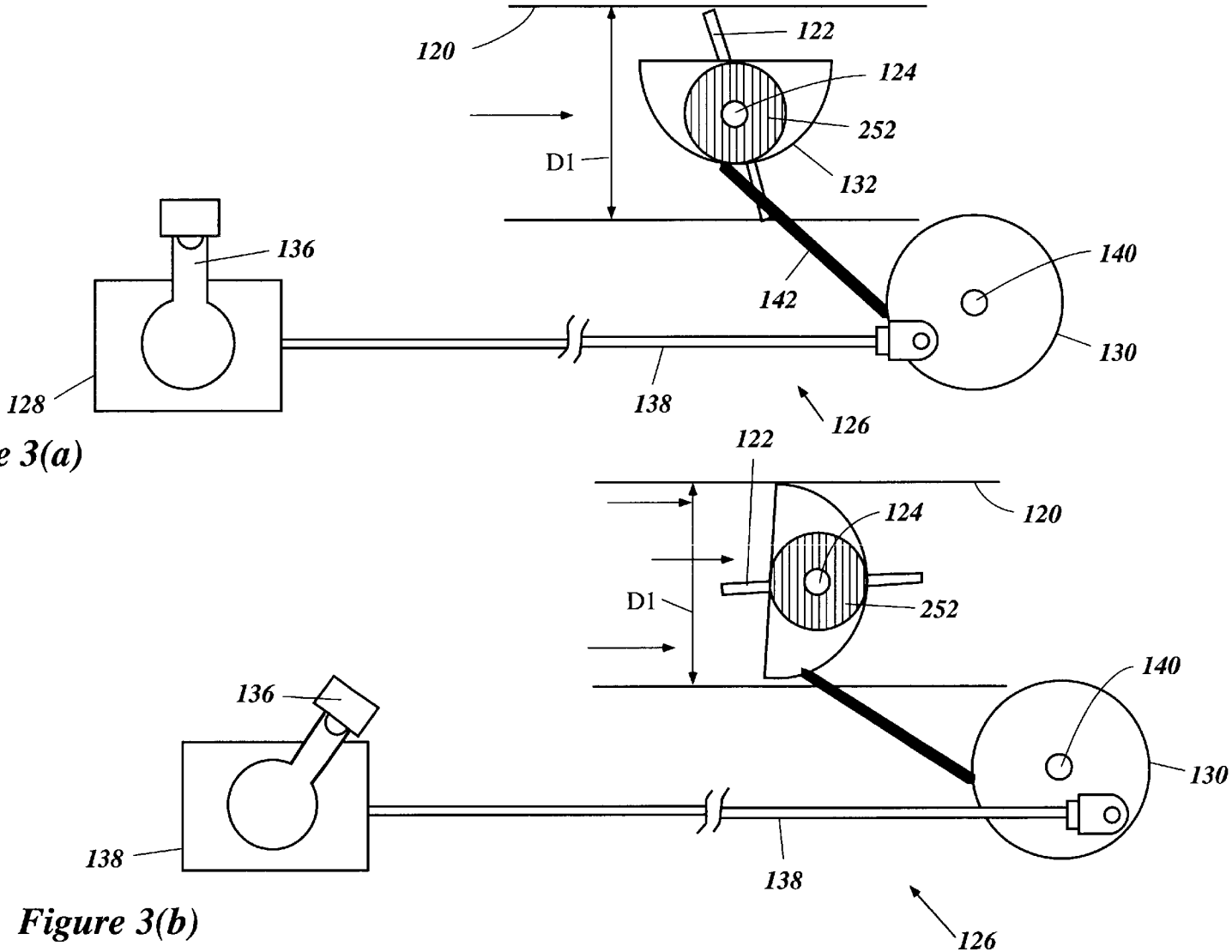
FIGS. 3(*a*) and 3(*b*) are schematic views of a throttle valve actuation mechanism applied to the control system and using a pulley type actuator responsive to a controller, wherein FIG. 3(*a*) illustrates the throttle valve in a fully closed position and FIG. 3(*b*) illustrates the throttle valve in a fully open position.

FIGS. 1–3 illustrate an overall construction of an outboard motor 30 that incorporates an internal combustion engine 32. The internal combustion engine 32 is controlled by a control system 33 configured in accordance with certain features, aspects and advantages of the present invention as described below in connection with exemplary embodiments. The engine 32 has particular utility in the context of an outboard motor, and thus is described in the context of an outboard motor. The engine 32, however, can be used with other types of marine drives (e.g., inboard motors, inboard/outboard motors, etc).

As illustrated in FIG. 1, the outboard motor 30 generally comprises a drive unit 34 and a bracket assembly 36. The bracket assembly 36 supports the drive unit 34 on a transom 38 of an associated watercraft 40 (shown in partial cross section). The drive unit 34 is positioned on the watercraft 40 such that a marine propulsion device 41 at a lower portion of the drive unit 34 is submerged when the watercraft 40 is floating on a body of water. The bracket assembly 36 preferably comprises a swivel bracket 42, a clamping bracket 44, a steering shaft and a pivot pin 46.

The steering shaft typically extends through the swivel bracket 42 and is affixed to the drive unit 34 by top and bottom mount assemblies. The steering shaft is pivotally journaled for steering movement about a generally vertically extending steering axis defined within the swivel bracket 42. The clamping bracket 44 comprises a pair of bracket arms that are spaced apart from each other and that are affixed to the watercraft transom 38. The pivot pin 46 completes a hinge coupling between the swivel bracket 42 and the clamping bracket 44. The pivot pin 46 extends through the bracket arms so that the clamping bracket 44 supports the swivel bracket 42 for pivotal movement about a generally horizontally extending tilt axis defined by the pivot pin 46. The drive unit 34 thus can be tilted or trimmed about the pivot pin 46.

As used through this description, the terms "forward," "forwardly," "front side" and "front" with respect to the drive unit 34 mean at or to the side where the bracket assembly 36 is located, and the terms "rear," "reverse," "backward," "backwardly," "rear side" and "rearward" with respect to the drive unit mean at or to the opposite side of the front side, unless indicated otherwise or otherwise readily apparent from the context in which the terms are used.

A hydraulic tilt and trim adjustment system preferably is provided between the swivel bracket 42 and the clamping bracket 44 for tilt movement (raising or lowering) of the swivel bracket 42 and the drive unit 34 relative to the clamping bracket 44. Alternatively, the outboard motor 30 can have a manually operated system for tilting the drive unit 34.

The illustrated drive unit 34 comprises a power head 50 and a housing unit 52. The housing unit 52 includes a driveshaft housing 54 and a lower unit 56. The power head 50 is disposed on top of the drive unit 34. The power head 50 includes the engine 32 and a protective cowling assembly 60. Preferably, the protective cowling assembly 60 is made of plastic; however, other suitable materials can also be used. The protective cowling assembly 60 defines a generally closed cavity 62 in which the engine 32 is disposed. The protective cowling assembly 60 preferably comprises a top cowling member 64 and a bottom cowling member 66.

The top cowling member 64 preferably is detachably affixed to the bottom cowling member 66 by a coupling mechanism so that a user, operator, mechanic or repairperson can access the engine 32 for maintenance or for other purposes. The top cowling member 64 preferably has a rear intake opening on its rear portion and its top portion. The ambient air enters the closed cavity 62 through the intake opening. Typically, the top cowling member 64 tapers in girth toward its top surface, which is in the general proximity of the air intake opening.

The bottom cowling member 66 preferably has an opening through which an upper portion of an exhaust guide member 70 extends. The exhaust guide member 70 preferably is made of aluminum alloy and is affixed atop the driveshaft housing 54. The bottom cowling member 66 and the exhaust guide member 70 together generally form a tray. The engine 32 is placed onto this tray and is affixed to the exhaust guide member 70. The exhaust guide member 70 also has an exhaust passage through which burnt charges (e.g., exhaust gases) from the engine 32 are discharged.

The engine 32 in the illustrated embodiment of FIGS. 1 and 2 preferably operates on a four-cycle combustion principle. The engine 32 has a cylinder block 74. The presently preferred cylinder block 74 defines four in-line cylinder bores 76 which extend generally horizontally and which are generally vertically spaced from one another. As used in this description, the term "horizontally" means that the subject portions, members or components extend generally in parallel to the water line when the associated watercraft 40 is substantially stationary with respect to the water line and when the drive unit 34 is not tilted as illustrated by the position of the drive unit 34 in FIG. 1. The term "vertically" means that portions, members or components extend generally normal to those that extend horizontally. This type of engine, however, merely exemplifies one type of engine on which various aspects and features of the present invention can be suitably used. Engines having other numbers of cylinders, having other cylinder arrangements (e.g., V, W, opposing, etc.), and operating on other combustion principles (e.g., crankcase compression two-stroke, diesel, or rotary) also can be applied. Regardless of the particular construction, the engine preferably comprises an engine body that includes at least one cylinder bore.

At least one moveable member moves relative to the cylinder block 74 in a suitable manner. In the illustrated arrangement, the moveable member comprises a respective piston 80 that reciprocates within each cylinder bore 76.

A cylinder head member 82 is affixed to one end of the cylinder block 74 to close one end of each of the cylinder bores 76. The cylinder head member 82, the associated pistons 80 and cylinder bores 76 define four combustion chambers 84. A cylinder head cover member 86 covers the cylinder head member 82.

A crankcase member 88 closes the other end of the cylinder bores 76. The crankcase member 88 and the cylinder block 74 define a crankcase chamber. A crankshaft 90 extends generally vertically through the crankcase chamber and is advantageously journaled for rotation by several bearing blocks. A respective connecting rod 92 couples the crankshaft 90 with each of the pistons 80 in any suitable manner. Thus, the crankshaft 90 is caused to rotate in response to the reciprocal movement of the pistons 80.

Preferably, the crankcase member 88 is located at the most forward position of the engine 32, with the cylinder block 74 being disposed rearward from the crankcase member 88, and with the cylinder head member 82 being disposed rearward from the cylinder block 74. Generally, the cylinder block 74, the cylinder head member 82 and the crankcase member 88 together define an engine body 96. Preferably, at least these major engine portions 74, 82, 86, 88 are made of an aluminum alloy. The aluminum alloy advantageously increases strength over cast iron while decreasing the weight of the engine body 96.

The engine 32 also includes an air intake device 100. The air intake device 100 draws air from within the cavity 62 to the combustion chambers 84. The air intake device 100 preferably comprises eight intake ports, four intake passages 102 and a single plenum chamber 104. In the illustrated arrangement, two intake ports are allotted to each combustion chamber 84, and the two intake ports for each chamber communicate with a respective one of the intake passages 102.

The intake ports are defined in the cylinder head member 82. Intake valves 108 are slidably disposed at the cylinder head member 82 to move between an open position and a closed position of the intake ports to control the flow of air into the combustion chamber 84.

Biasing members, such as springs, are used to urge the intake valves 108 toward the respective closing positions. When each intake valve 108 is in the open position, the intake passage 102 that is associated with the intake port communicates with the associated combustion chamber 84.

Each intake passage 102 preferably is defined with an intake conduit 112. The illustrated intake conduits 112 extend forwardly alongside of and to the front of the crankcase member 88.

The plenum chamber 104 is defined with a plenum chamber member 116. The plenum chamber member 116 has an air inlet 118 that defines an air inlet passage 120 through which the air in the cavity 62 is drawn into the plenum chamber 104. The air inlet passage 120 has an inner diameter D1 (FIGS. 3(*a*) and 3(*b*)) selected to provide an adequate quantity of air to the combustion chambers of the engine 32 for the maximum air intake requirements of the engine 32. In some arrangements, the plenum chamber 104 acts as an intake silencer to attenuate noise generated by the flow of air into the respective combustion chambers 84. In the illustrated arrangement, the air inlet 118 forms a throttle body. Thus, the reference numeral 118 also indicates the throttle body in this description.

As shown in FIG. 2 and in FIGS. 3(*a*) and 3(*b*), the throttle body 118 incorporates a butterfly type throttle valve 122 journaled for pivotal movement about an axis defined by a valve shaft 124. The throttle valve 122 is operable by the operator through a throttle valve actuation mechanism 126. The throttle valve 122 operates as an air regulator. Although described herein in connection with the throttle valve 122, it should be understood that other air regulators can also be used to implement alternative embodiments of the invention described herein.

In the arrangement illustrated in FIGS. 3(*a*) and 3(*b*), the mechanism 126 comprises a remotely disposed controller 128, a full pulley 130 and a half (e.g., semicircular) pulley 132. The controller 128 is disposed at, for example, a cockpit of the watercraft 40 and has a throttle control lever 136 journaled for pivotal movement under manual control of an operator. The control lever 136 and the full pulley 130 are connected with each other through a throttle cable 138 which generally extends horizontally.

The full pulley 130 is journaled at either the throttle body 118, at the plenum chamber member 116 or at another suitable member by a pulley shaft 140. The full pulley 130 pivots about an axis of the pulley shaft 140.

The half pulley 132 is affixed to the throttle valve 122 and is journaled at the valve shaft 124. A connecting wire 142 has a first end affixed to the full pulley 130 and has a second end affixed to the half pulley 132 to thereby interconnect the full pulley 130 and the half pulley 132. Preferably, a bias spring (not shown) is provided to normally urge the throttle valve 22 or the half pulley 132 such that the throttle valve 122 is held at the fully closed position unless the half pulley 132 is moved via the connecting wire 142.

When the operator operates the throttle control lever 136, the full pulley 130 is moved via the throttle cable 138 and pivots about the axis of the pulley shaft 140. The pivotal movement of the full pulley 130 moves the half pulley 132 via the connecting wire 142. Accordingly, the half pulley 132 pivots about the axis of the valve shaft 124. Because the half pulley 132 is affixed to the throttle valve 122, the throttle valve 122 also pivots about the axis of the valve shaft 124. The throttle valve 122 thus is movable against the biasing force of the spring between the fully closed position shown in FIG. 3(*a*) and the fully open position shown in FIG. 3(*b*).

The full pulley 130 forms an actuator that actuates the throttle valve 132. Thus, the throttle valve 122 in this arrangement moves linearly (e.g., proportionally) relative to the movement of the actuator (i.e., the full pulley 130) and also relative to the movement of the control lever 136.

As the throttle valve 122 moves between the fully closed position and the fully open position, the throttle valve 122 regulates an amount of air flowing through the air inlet passage 120. Normally, the greater the opening degree of the throttle valve (e.g., the closer the throttle valve position is to the fully open position), the higher the rate of airflow and the higher the power output from the engine.

In some alternative arrangements, a respective throttle body 118 can be provided at each intake conduit 112. Each throttle valve in this alternative regulates air flow in each intake conduit 112.

In order to bring the engine 32 to idle speed and to maintain this speed, the throttle valve 122 generally is substantially closed; however, the valve 122 is preferably not fully closed so as to produce a more stable idle speed and to prevent sticking of the throttle valve 122 in the closed position. As used through the description, the term "idle speed" generally means a low engine speed that is achieved when the throttle valve 122 is closed but also includes a state such that the valve 122 is slightly more open to allow a minute amount of air to flow through the intake passages 102.

As shown in FIG. 2, the air intake device 100 preferably includes an auxiliary air device (AAD) 144 that bypasses the throttle valve 122 with a bypass passage 146. Idle air can be delivered to the combustion chambers 84 through the AAD 144 when the throttle valve 122 is placed in a substantially closed or fully closed position.

The AAD 144 preferably comprises an auxiliary valve that controls air flow through the bypass passage 146 such that the amount of the air flow can be fine-tuned. Preferably, the auxiliary valve is a needle valve that can move between an open position and a closed position to selectively close the bypass passage 146. The illustrated AAD 144 is affixed to the air inlet or throttle body 118. The throttle body 118 and the AAD 144 together form a throttle device 148 in this arrangement.

The AAD 144, in particular, the auxiliary valve, is controlled by an electronic control unit (ECU) 150 through a control line 151. The ECU 150 preferably is mounted on the engine body 96 at an appropriate location. The ECU 150 forms a control device that is a primary part of the control system 33 and will be described in greater detail below.

The engine 32 also comprises an exhaust device that guides burnt charges, e.g., exhaust gases, to a location outside of the outboard motor 30. Each cylinder bore 76 preferably has two exhaust ports (not shown) defined in the cylinder head member 82. The exhaust ports can be selectively opened and closed by exhaust valves 152. The construction of each exhaust valve 152 and the arrangement of the exhaust valves 152 are substantially the same as construction of the intake valves 108 and the arrangement thereof, respectively.

An exhaust passage 154 preferably is disposed proximate to the combustion chambers and extends generally vertically. For example, an exhaust manifold 156 defines the exhaust passage 154 in the illustrated embodiment. The exhaust passage 154 communicates with the combustion chambers 84 through the exhaust ports to collect exhaust gases therefrom. The exhaust manifold 156 couples the foregoing exhaust passage 154 with the exhaust guide member 70. When the exhaust ports are opened, the exhaust gases from the combustion chambers 84 pass through the exhaust passage 154 to the exhaust passage of the exhaust guide member 70.

Preferably, a valve cam mechanism is provided to actuate the intake valves 108 and the exhaust valves 152. In the illustrated arrangement, the valve cam mechanism includes an intake camshaft 160 and an exhaust camshaft 162 both extending generally vertically and both journaled for rotation relative to the cylinder head member 82. In the illustrated arrangement, bearing caps journal the camshafts 160, 162 with the cylinder head member 82. The cylinder head cover member 86 preferably defines a camshaft chamber together with the cylinder head member 82.

Each camshaft 160, 162 has cam lobes 164 to push valve lifters that are affixed to the respective ends of the intake and exhaust valves 108, 152. The cam lobes 164 repeatedly push the valve lifters in a timed manner proportional to the engine speed, e.g., the speed of rotation of the crankshaft 90. The movement of the lifters generally is timed by the rotation of the camshafts 160, 162 to appropriately actuate the intake and exhaust valves 108, 152.

A camshaft drive mechanism drives the valve cam mechanism. The intake camshaft 160 and the exhaust camshaft 162 respectively comprise a driven intake sprocket positioned atop the intake camshaft 160 and a driven exhaust sprocket positioned atop the exhaust camshaft 162. The crankshaft 90 in turn has a drive sprocket positioned at an upper portion thereof. Of course, other locations of the sprockets also are applicable.

A timing chain or belt is wound around the driven sprockets and the drive sprocket. Thus, when the crankshaft 90 turns and rotates the drive sprocket, the timing chain or belt causes the driven sprockets to rotate and therefore rotate the camshafts 160, 162 in a timed relationship. Because the camshafts 160, 162 must rotate at half of the speed of the rotation of the crankshaft 90 in the four-cycle combustion principle, a diameter of each of the driven sprockets is twice as large as a diameter of the drive sprocket.

As further shown in FIG. 2, the engine 32 preferably has a port or manifold fuel injection system. The fuel injection system preferably comprises four fuel injectors 168. One injector is allotted for each of the respective combustion chambers 84 through suitable fuel conduits, such as fuel rails. The fuel injectors 168 preferably are mounted on the fuel rail, which is mounted on the cylinder head member 82. Each fuel injector 168 preferably has an injection nozzle directed toward the associated intake passage adjacent to the intake ports. The ECU 150 controls the fuel injectors 168 through a control line 170.

In addition to the fuel injectors 168 and the fuel rail, the fuel injection system comprises a fuel storage tank 172, a fuel filter 174, a low speed fuel pump 176, a vapor separator tank 178, a high speed fuel pump 180 and a pressure regulator 182.

The fuel storage tank 172 preferably is located in the hull of the associated watercraft 40 to store fuel that is supplied to the fuel injectors 168. A vapor separator tank 180 preferably is disposed on a side wall of the engine body. Fuel in the storage tank 172 is delivered to the vapor separator tank 180 by the low pressure pump 76 through a fuel supply passage 184, which includes the fuel filter 174. The vapor separator tank 180 removes vapor in the fuel. The illustrated high pressure fuel pump 180 is submerged in the fuel within the vapor separator 180 and pumps out the fuel toward the fuel injectors 168 through fuel delivery passages 186, 188.

The pressure regulator 182 is connected to the fuel delivery passages 186, 188 via a return passage 190 and is also connected with the vapor separator tank 180 via another return passage 192. The pressure regulator 182 is also connected to the plenum chamber 104 via an air passage 194. Air in the plenum chamber 104, however, does not flow through the air passage 194. Only the intake pressure in the plenum chamber 104 is transmitted to the regulator 182 through the air passage 194 such that the pressure regulator 182 is responsive to the intake pressure.

The fuel injectors 168 spray fuel into the intake passages 102 under control of the ECU 150. The illustrated ECU 150 controls both the initiation timing and the duration of every injection so that the nozzles spray a proper amount of the fuel at a correct time during each combustion cycle. The pressure regulator 182 regulates the fuel pressure by returning a surplus amount of the fuel to the vapor separator 178 through the return passages 190, 192. The pressure regulator 182 advantageously regulates the pressure to a substantially constant magnitude. Thus, the proper amount of the injected fuel is controlled by the duration of the injection. In other words, since the pressure is substantially constant, the injected fuel amount varies in proportion to the duration of the injection.

Alternatively, the fuel injectors 168 can be disposed for direct cylinder injection. In this alternative, the fuel injectors 168 directly spray the fuel into the combustion chambers 84 rather than into the intake passages 102.

In general, the fuel amount is determined basically such that the air-fuel ratio of the charge in the combustion chambers 84 is equal to the stoichiometric air-fuel ratio. Theoretically, the stoichiometric air-fuel ratio is the most ideal air-fuel ratio because, at the stoichiometric air-fuel ratio, the fuel charge can be completely burned. When gasoline is used as the fuel, the stoichiometric air-fuel ratio is approximately 14.7. To a certain extent, the engine 32 can operate at an air-fuel ratio other than the stoichiometric air-fuel ratio. For example, in some circumstances, a leaner air-fuel ratio provides a greater fuel economy. A control of the fuel injectors 168 practiced in this embodiment will be described in greater detail below As further shown in FIG. 2, the engine 32 further comprises an ignition or firing system. Each combustion chamber 84 is provided with a spark plug 196 that is connected to the ECU 150 via an ignition device 198 and a control line 200 so that ignition timing is also controlled by the ECU 150. Each spark plug 196 has electrodes that are exposed in the associated combustion chamber 84 and are spaced apart from each other with a small gap. The illustrated ignition device 198 comprises power transistors 202 and ignition coils 204 which are connected in series with each other. Each spark plug 196 is responsive to the ignition device 198 to generate a spark between the electrodes to ignite an air-fuel charge in the respective combustion chamber 84 at selected ignition timing under control of the ECU 150.

In the illustrated engine 32, the pistons 80 reciprocate between top dead center and bottom dead center. When the crankshaft 90 makes two rotations, the pistons 80 generally move from the top dead center to the bottom dead center (the intake stroke), from the bottom dead center to the top dead center (the compression stroke), from the top dead center to the bottom dead center (the power stroke) and from the bottom dead center to the top dead center (the exhaust stroke). During the four strokes of the pistons 80, the camshafts 160, 162 make one rotation and actuate the intake valves 108 and the exhaust valves 152 to open the intake ports during the intake stroke and to open exhaust ports during the exhaust stroke, respectively.

Generally, during the intake stroke, air is drawn into the combustion chambers 84 through the air intake passages 102 and fuel is injected into the intake passages 102 by the fuel injectors 168. The air and the fuel thus are mixed to form the air-fuel charge in the combustion chambers 84. Slightly before or during the power stroke, the respective spark plug 196 ignites the compressed air-fuel charge in the respective combustion chamber 84. The air-fuel charge thus rapidly burns during the power stroke to move the pistons 80. The burnt charge (e.g., exhaust gases) is then discharged from the combustion chamber 84 during the exhaust stroke.

During the engine operation, heat is generated in the combustion chambers 84, and the temperature of the engine body 96 increases. The illustrated engine 32 thus includes a cooling system to cool the engine body 96. The outboard motor 30 preferably employs an open-loop type water cooling system that introduces cooling water from the body of water surrounding the motor 30 and then discharges the water to the water body. The cooling system includes one or more water jackets 208 defined within the engine body 96 through which the introduced water travels around to remove heat from the engine body 96.

The engine 32 also preferably includes a lubrication system. A closed-loop type system preferably is employed in the illustrated embodiment. The lubrication system comprises a lubricant tank 210 (FIG. 1) that defines a reservoir cavity, which preferably is positioned within the driveshaft housing 54. An oil pump (not shown) is located, for example, on top of the driveshaft housing 54. The oil pump pressurizes the lubricant oil in the reservoir cavity. The lubricant oil is conveyed to certain engine portions via lubricant delivery passages to provide lubrication to various moving parts of the engine. Lubricant return passages return the oil to the lubricant tank for recirculation.

A flywheel assembly (not shown) preferably is positioned at the upper portion of the crankshaft 90 and is mounted onto one end of the crankshaft 90 so as to rotate the flywheel as the crankshaft 90 rotates. The flywheel assembly includes a flywheel magneto or AC generator that supplies electric power to various electrical components such as the fuel injection system, the ignition system and the ECU 150.

As further shown in FIG. 1, the driveshaft housing 54 depends from the power head 50 to support a driveshaft 214 which is coupled with the crankshaft 90 and which extends generally vertically through the driveshaft housing 54. The driveshaft 214 is journaled for rotation and is driven by the crankshaft 90. The driveshaft housing 54 preferably defines an internal section of the exhaust system that conveys most of the exhaust gases to the lower unit 56. An idle discharge section branches from the internal section to discharge idle exhaust gases directly out to the atmosphere through a discharge port that is formed on a rear surface of the driveshaft housing 54 in idle speed of the engine 32. The driveshaft 214 preferably drives the oil pump.

As further shown in FIG. 1, the lower unit 56 depends from the driveshaft housing 54 and supports a propulsion shaft 216 that is driven by the driveshaft 214. The propulsion shaft 216 extends generally horizontally through the lower unit 56 and is journaled for rotation. The propulsion device 41 is attached to the propulsion shaft 216. In the illustrated arrangement, the propulsion device 41 includes a propeller 218 that is affixed to an outer end of the propulsion shaft 216. The propulsion device, however, can be a dual counter-rotating system, a hydrodynamic jet, or any other suitable propulsion device.

As shown in FIG. 1, the driveshaft 214 and the propulsion shaft 216 are preferably oriented normal to each other (e.g., the rotation axis of propulsion shaft 216 is at 90° to the rotation axis of the drive shaft 214). A transmission 222 preferably is provided between the driveshaft 214 and the propulsion shaft 216 to couple the two shafts 214, 216 by bevel gears, for example. The transmission 222 incorporates a changeover unit (e.g., a shifting device) 224 that changes the operational mode of the propeller 218 via a shift mechanism in the transmission 222. The operational modes of the propeller 218 include a first mode (e.g., a forward mode), a second mode (e.g., a neutral mode) and a third mode (e.g., a reverse mode). In the first operational mode, the propeller 218 is rotated in a first rotational direction to impart a forward motion to the watercraft 40. In the second operational mode the propeller 218 does not rotate and does not impart motion to the watercraft 40. In the third operational mode, the propeller is rotated in a second rotational direction opposite the first rotational direction to impart a backward motion to the watercraft 40.

The changeover unit 224 preferably is operated by the operator with a shift control lever (not shown) of the controller 128 (FIGS. 3(*a*) and 3(*b*)). The movements of the shift control lever of the controller 128 are communicated to the changeover unit 224 via a shift cable 230, a slider 232 and a shift control shaft 234. The shift control lever is disposed proximate to the throttle control lever 136 and is pivoted with respect to the body of the controller 128 for pivotal movement. The shift cable 230 generally extends horizontally from the controller 128 in the cockpit of the watercraft 40 to the marine drive 30 and is preferably located proximate the throttle cable 138. The slider 232 connects the shift cable 230 and the shift control shaft 234. The shift control shaft 234 extends generally vertically through the steering shaft and a front portion of the housing unit 52. When the operator operates the shift control lever, the pivotal movement of the shift control lever is communicated as longitudinal movement of the shift cable 230 and the slider 232. The longitudinal movement of the slider 232 causes rotational movement of the shift control shaft 234 that is communicated to the changeover unit 224 to cause the changeover unit 234 to change the rotational direction of the propeller 218.

The lower unit 56 also defines an internal section of the exhaust system that is connected with the internal section of the driveshaft housing 54. At engine speeds above idle, the exhaust gases generally are discharged to the body of water surrounding the outboard motor 30 via the internal sections and then via a discharge section defined within the hub of the propeller 218.

The illustrated ECU 150 is coupled to sensors that sense operational conditions of the engine 32, operational conditions of the outboard motor 30, or operational conditions of both the engine 32 and the outboard motor 30. In preferred embodiments of the system described herein, the ECU 150 receives sensed information (e.g., parameters representing operating conditions) at least from an intake pressure sensor 250 via a sensor line 262, from a throttle valve position sensor 252 via a sensor line 264, from a camshaft angle position sensor 254 via a sensor line 266, from an intake temperature sensor 256 via a sensor line 268, from a water temperature sensor 258 via a sensor line 270 and from an oxygen ($O_2$) sensor 260 via a sensor line 272.

The intake pressure sensor 250 preferably is located on the plenum chamber member 116 so that a sensor tip thereof is positioned within the plenum chamber 104 to sense an intake pressure therein. The intake pressure sensor 250 sends an intake pressure signal to the ECU 150 via the signal line 262. Because the plenum chamber 104 is connected to the respective intake passages 102, the signal of the intake pressure sensor 250 advantageously represents a condition of the intake pressure of each intake passage 250 that is in the intake stroke. Alternatively, the intake pressure sensor 250 can be located in one of the intake passages 102.

The throttle position sensor 252 preferably is located proximate the valve shaft 124 of the throttle valve 122 to sense an angular position between the open angular position and the closed angular position of the throttle valve 122. The throttle position sensor 252 sends a throttle valve position signal (e.g., an opening degree signal) to the ECU 150 via the signal line 264.

By sensing the throttle opening degree, the throttle valve position sensor 252 senses the operator's demand or engine load. Generally, the intake pressure also varies in proportion to the change of the throttle opening degree, and the intake pressure is sensed by the intake pressure sensor 250. For example, when the throttle valve 122 opens in response to the operation of the throttle control lever 136 by the operator to increase the speed of the watercraft 40, the intake pressure decreases. As another example, the engine load may increase when the watercraft 40 advances against wind and the operator operates the throttle control lever 136 (FIGS. 3(*a*) and 3(*b*)) to maintain a desired speed of the watercraft 40.

The camshaft angle position sensor 254 preferably is positioned on or proximate to the exhaust camshaft 162 to sense an angular position of the exhaust camshaft 162. Alternatively, the sensor 254 can be positioned on or proximate to the intake camshaft 160 because the two camshafts 160, 162 are mutually synchronized. In this description, the illustrated exhaust camshaft 162 (or, alternatively, the intake camshaft 160) is referred to as a second movable member. The camshaft angle position sensor 254 sends a signal to the ECU 150 via the signal line 266. As described above, the exhaust camshaft 162 and the intake camshaft 160 are driven by the crankshaft 90 through the camshaft drive mechanism. The signal of the camshaft angle position sensor 254 thus can be used to calculate an engine speed at the ECU 150. The ECU 150 includes an engine speed calculating unit 276, which is part of a control program. The unit 276 calculates the engine speed by evaluating the changes in the signal from the camshaft angle position sensor 254 as a function of time (e.g., a rotation rate of the camshaft). The engine speed calculating unit 276 thus forms an engine speed sensor in this description. In certain alternative arrangements, a signal from a crankshaft angle position sensor, which detects an angular position of the crankshaft 90, can advantageously be used for calculating the engine speed.

The intake temperature sensor 256 preferably is located on the plenum chamber member 116 so that a sensor tip thereof is positioned within the plenum chamber 104 to sense a temperature of the intake air in the plenum chamber 104. The intake temperature sensor 256 sends an intake temperature signal to the ECU 150 via the signal line 268.

The water temperature sensor 258 preferably is located at the cylinder head member 82 so that a sensor tip thereof is positioned within the water jacket to sense a temperature of the cooling water. The water temperature sensor 258 sends a water temperature signal to the ECU 150 via the signal line 270. Generally, the signal from the water temperature sensor 258 represents a temperature of the engine body 96.

The oxygen sensor 260 preferably is located on the exhaust conduit 156 so that a sensor tip thereof is positioned within the exhaust passage 154 to sense an amount of the oxygen ($O_2$) remaining in the exhaust gases. The oxygen sensor 260 sends a signal indicative of the amount of the residual oxygen to the ECU 150 via the signal line 272. The ECU 150 uses the signal from the oxygen sensor 260 to determine an air-fuel ratio. Thus, the oxygen sensor 260 advantageously functions as an air-fuel ratio sensor.

The signal lines preferably are configured with hard wires (e.g., insulated copper wires), which may be bundled in a wiring harness or the like. Alternatively, the signals can be sent through optical emitter and detector pairs, infrared radiation, radio waves or the like. The type of signal and the type of interconnection can be the same for all the sensor signals, or the type of signal and the type of interconnection can be different for some of the sensors. The control lines described herein can also use different types of signals and interconnections.

In the alternative embodiments of the control system 33, sensors other than the sensors described above can also advantageously be provided to sense the operational condition of the engine 32, the outboard motor 30 or both. For example, an oil pressure sensor and a knock sensor can also be included to provide additional condition information to the ECU 150.

The ECU 150 preferably is configured as a feedback control device that uses the signals of the sensors for feedback. Preferably, the ECU 150 comprises a central processing unit (CPU) and at least one storage unit. The storage unit holds various control maps. For example, the control maps include data regarding parameters that are used by the ECU 150 to determine optimum or target control conditions at every moment. The ECU 150 controls at least the fuel injectors 168, the ignition device 198 and the AAD 144 in accordance with the target control conditions and monitors actual conditions using the signals from the sensors to determine whether the actual conditions differ from the target control conditions. The ECU 150 is responsive to the sensed actual conditions to generate control signals to the fuel injectors 168, to the ignition device 198 and to the AAD 144 to cause the actual control conditions to vary toward the target control conditions if the ECU 150 determines that one or more of the actual conditions differ from the corresponding target control conditions.

Figure 4:
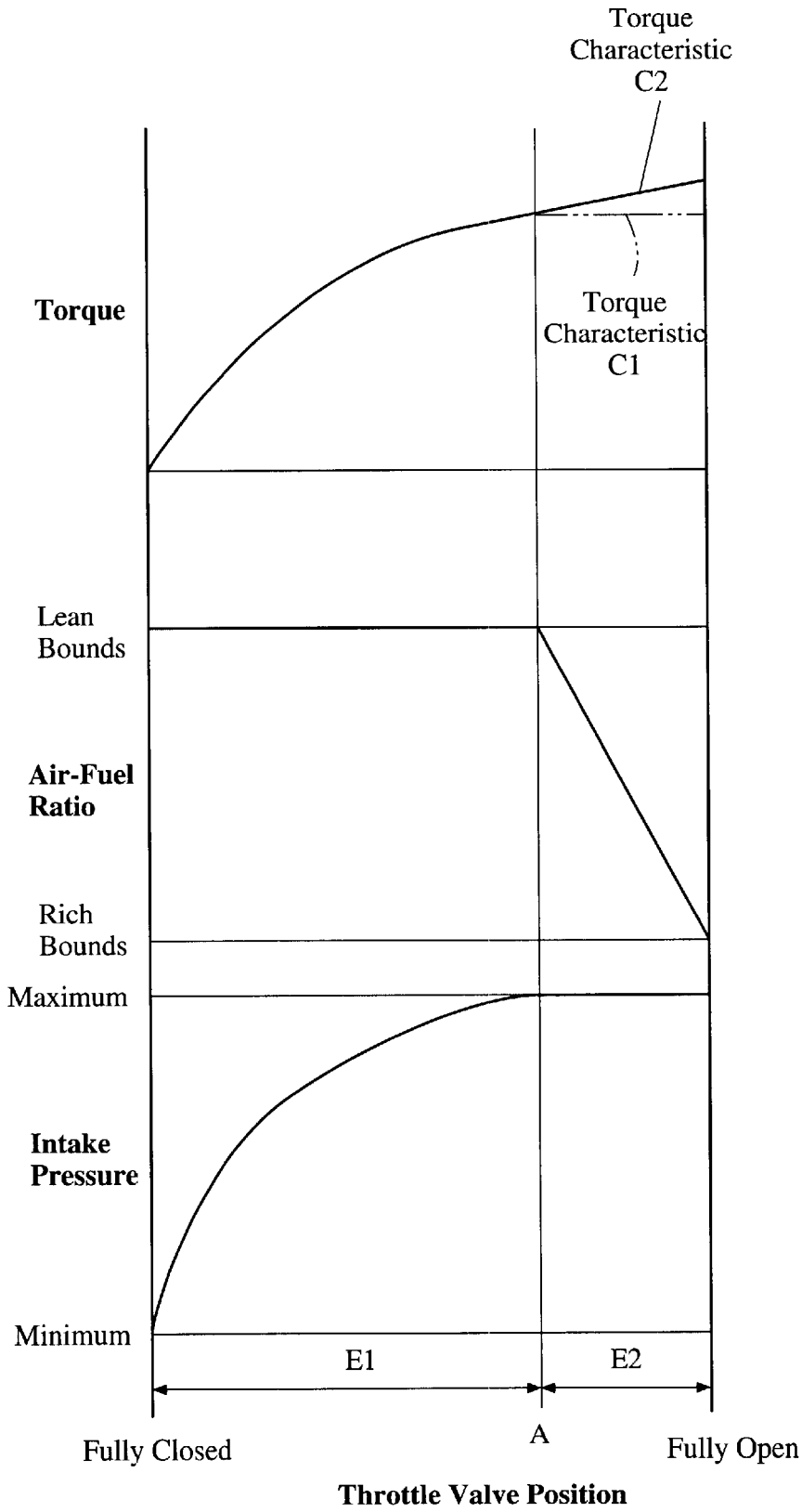
FIG. 4 is a graphical illustration of relationships among intake pressures (lower graph), air-fuel ratios (middle graph) and output torque (upper graph) versus throttle valve positions.
Figure 7:
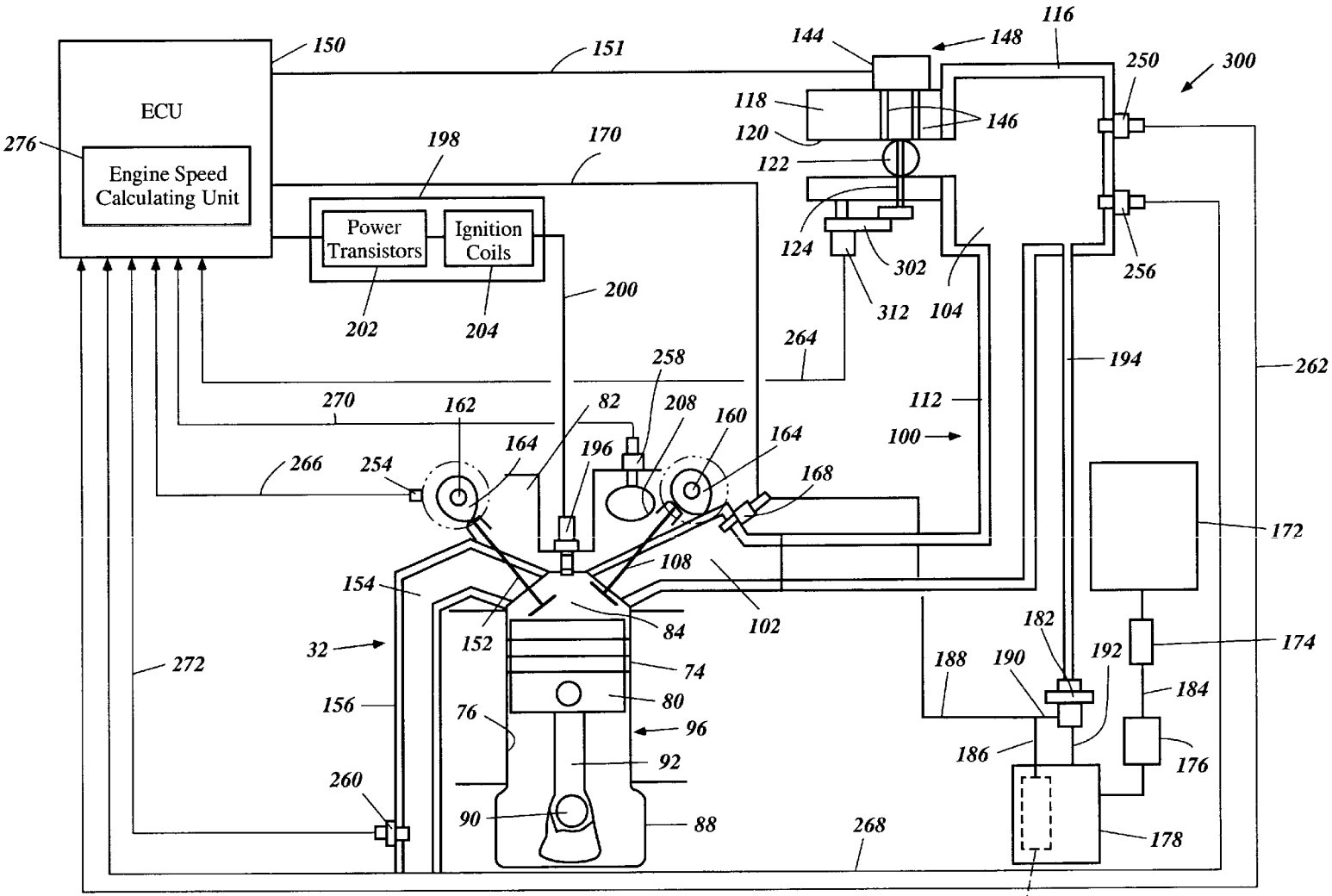
FIG. 7 is a schematic view of a control system in accordance with an alternative embodiment.

An air-fuel ratio control function of the control system 33 is described below in connection with FIG. 4. In particular, FIG. 4 illustrates relationships among intake pressures, air-fuel ratios and output torque in response to throttle valve positions. As illustrated by the lowermost graph of FIG. 4, the intake pressure increases from a minimum pressure when the throttle valve 122 is initially opened from the fully closed position, and the intake pressure generally reaches the maximum pressure at a throttle valve position A. Thus, the intake air amount at the position A is generally the maximum amount. The position A is not the fully open position of the throttle valve 122, and the throttle valve 122 can move further to the fully open position in this arrangement. In the air-fuel ratio control function, the ECU 150 has knowledge of the position A as a result of, for example, previously conducted experiments.

In FIG. 4, a range from the fully closed position of the throttle valve 122 to the position A is identified as a range E1. A range from the position A to the fully open position of the throttle valve 122 is identified as a range E2. As illustrated, the intake pressure is variable in the range E1 and is substantially invariable in the range E2. As described above, the throttle valve 122 is actuated by the full pulley (e.g., throttle actuator) 130. Thus, the range E1 defines a first actuation range of the throttle actuator 130, and the range E2 defines a second actuation range of the throttle actuator 130.

When the throttle actuator 130 actuates the throttle valve 122 in the first actuation range E1, the ECU 150 controls the fuel amount that is sprayed by each fuel injector 168 based primarily upon the signal from the intake pressure sensor 250 and the signal from the engine speed sensor 276. When the throttle actuator 130 actuates the throttle valve 122 in the second actuation range E2, the ECU 150 controls the fuel amount based upon the signal from the throttle valve position sensor 252 and the signal from the engine speed sensor 276. As illustrated by the middle graph in FIG. 4, the control signals generated by the ECU 150 in the first actuation range E1 produce a lean air-fuel ratio. For example, in the illustrated embodiment, the lean air-fuel ratio produced by the ECU 150 is approximately 20, which is almost an upper boundary for a lean air-fuel ratio. As further illustrated by the middle graph in FIG. 4, the control signals generated by the ECU 150 in the second actuation range E2 produce a richer air-fuel ratio. In particular, the air-fuel ratio in the second actuation range E2 is controlled to decrease as the throttle valve position changes toward the fully open position to produce the richest air-fuel ratio at the fully open position. In the illustrated example, the riches air-fuel ratio is approximately 12.5.

As illustrated by the upper graph in FIG. 4, the above-described control of the ECU 150 causes the engine torque to increase as the intake pressure increases in the first actuation range E1. Absent the above-described control, the torque would neither increase nor decrease in the second actuation range, as indicated by the generally horizontal phantom line C1 in the upper graph of FIG. 4. However, in the illustrated embodiment, the specific control function provided by the ECU 150 in the second range E2 causes the torque to increase as indicated by the solid line C2 and thus have a torque greater than it would otherwise have in the absence of the control function.

As described above, the air-fuel ratio in the first actuation range E1 is lean in the illustrated embodiment. Thus, the rate of fuel consumption in the first actuation range E1 can be small. When the throttle valve position reaches the position A at the limit of the first actuation range E1, the engine 32 operates at a relatively high engine speed, at a relatively high engine load, or at a relatively high speed and a relatively high load because the intake pressure is generally at the maximum. Accordingly, the first actuation range E1 sufficiently covers the normal operating range of the marine engine 32.

In addition, the illustrated ECU 150 controls the fuel amount in the range E2 so that a richer air-fuel ratio is provided in the highest speed range, the highest load range, or the highest speed and load ranges of the engine operation. The richer air-fuel ratio is still controllable by the control system 33 even after the intake pressure reaches the maximum pressure. Accordingly, the engine 32 can operate without stalling under conditions such as, for example, running at full speed or rapid acceleration.

FIGS. 5(*a*), 5(*b*) and 5(*c*) illustrate control maps used by the control system 33. In the control maps of FIGS. 5(*a*), 5(*b*) and 5(*c*), each column represents a first parameter and each row represents a second parameter. The entry at the intersection of each column and row represents a target value indexed by a particular combination of the column parameter and the row parameter, as discussed in more detail below.

FIG. 5(*a*) partially shows a set of injection duration maps D1, D2. Each entry in the main map D1 represents a primary injection duration (in tens of microseconds) for a combination of an air intake pressure (column index in kPa) and an engine speed (row index in rpm). Each entry in the correction map D2 represents an injection duration correction (in tens of microseconds) for a combination of a throttle valve position (column index in degrees) and an engine speed (row index in rpm).

FIG. 5(*b*) partially shows a set of ignition timing maps F1, F2. Each entry in the main map F1 represents a primary ignition time for a combination of an air intake pressure and an engine speed. Each entry in the correction map F2 represents an ignition time correction for a combination of a throttle valve position and an engine speed.

FIG. 5(*c*) partially shows a set of target air-fuel ratio maps T1, T2. Each entry in the main map T1 represents a primary target air-fuel ratio for a combination of an air intake pressure and an engine speed. Each entry in the correction map T2 represents a target air-fuel ratio correction for a combination of a throttle valve position and an engine speed.

The ECU 150 uses the injection duration information stored in the entries of the maps D1 and D2 and the target air-fuel ratio information stored in the entries of the maps T1 and T2 to control the amount of fuel injected into the engine (via the intake passages 102 or directly into the combustion chambers 84).

FIG. 6 illustrates an exemplary method for using the engine speed and the intake pressure as indices to the main map D1 of FIG. 5(*a*) to select a primary injection duration and for using the engine speed and the throttle valve position as indices to the correction map D2 of FIG. 5(*a*) to select an injection duration adjustment (e.g., injection duration correction). An adjusted injection duration is determined by adding the selected injection duration adjustment from the correction map D2 to the primary injection duration from the main map D1. For example, if the engine speed is 4000 rpm, the intake pressure is 100 kPa and the throttle valve position is 70 degrees, the primary injection duration is 7,340 (734×10) microseconds, and the injection duration adjustment is 2,060 (206×10) microseconds. Thus, the adjusted (e.g., corrected) injection duration is calculated as:

$$(734+206)\times 10=9{,}400 \text{ microseconds}$$

In a preferred strategy illustrated in FIG. 6, the adjustment of the injection duration occurs for smaller values of throttle valve opening at lower engine speeds in comparison to higher engine speeds. For example, at an engine speed of 600 rpm, the adjustment starts at the throttle valve position of 35 degrees, and at an engine speed of 4,000 rpm, the adjustment does not start until the throttle valve position is at 60 degrees. By increasing the injection duration at lower speeds, variations in the torque when the throttle control lever 136 is operated are reduced or eliminated.

The ignition timing main map F1 and the ignition timing correction map F2 of FIG. 5(*b*) are used by the ECU 150 in like manner to control the ignition timing by using the engine speed and the intake pressure as indices to the main map F1 to select a primary value for the ignition timing and using the engine speed and the throttle valve position as indices to the correction map F2 to select a correction (e.g., adjustment) value for the ignition timing. The two values are added together to obtain an adjusted value for the ignition timing. The adjusted ignition timing is advantageously selected so that the ignition timing is not too early (i.e., overly advanced), which may cause excess nitrogen oxides (NOx), and so that the ignition timing is not too late (i.e., overly retarded), which may cause large fluctuations in the combustion of the injected charge.

The target air-fuel ratio main map T1 and the target air-fuel ratio correction map T2 of FIG. 5(*c*) are used by the ECU 150 in like manner to control the target air-fuel ratio by using the engine speed and the intake pressure as indices to the main map T1 to select a primary value for the target air-fuel ratio and using the engine speed and the throttle valve position as indices to the correction map T2 to select a correction (e.g., adjustment) value for the target air-fuel ratio. The two values are added together to obtain an adjusted value for the target air-fuel ratio. The ECU 150 uses air-fuel feedback to adjust the air-fuel ratio to achieve the target air-fuel ratio.

A control system 300 configured in accordance with an alternative embodiment of the present invention is illustrated in FIGS. 7–10. The components, units, devices and matters described above are generally assigned the same reference numerals and symbols and will not be described further.

Figure 8A:
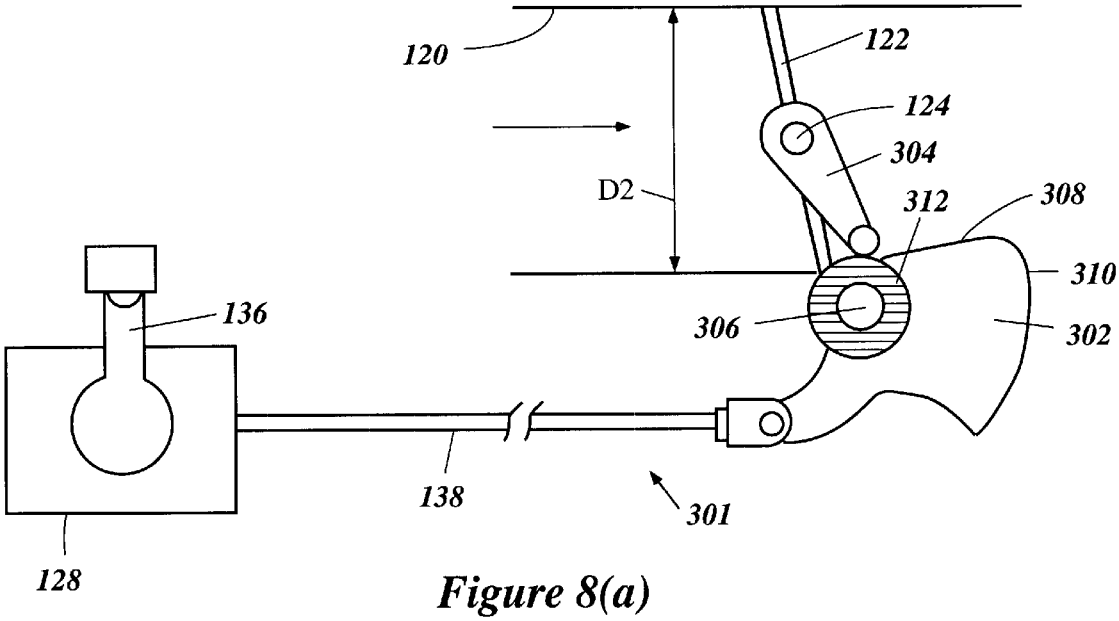
FIGS. 8(*a*) and 8(*b*) are schematic views of an alternative throttle valve actuation mechanism for use with the modified control system of FIG. 7, which uses a cam type actuator responsive to a controller, wherein FIG. 8(*a*) illustrates the throttle valve in a fully closed position and FIG. 8(*b*) illustrates the throttle valve in a fully open position.
Figure 8B:
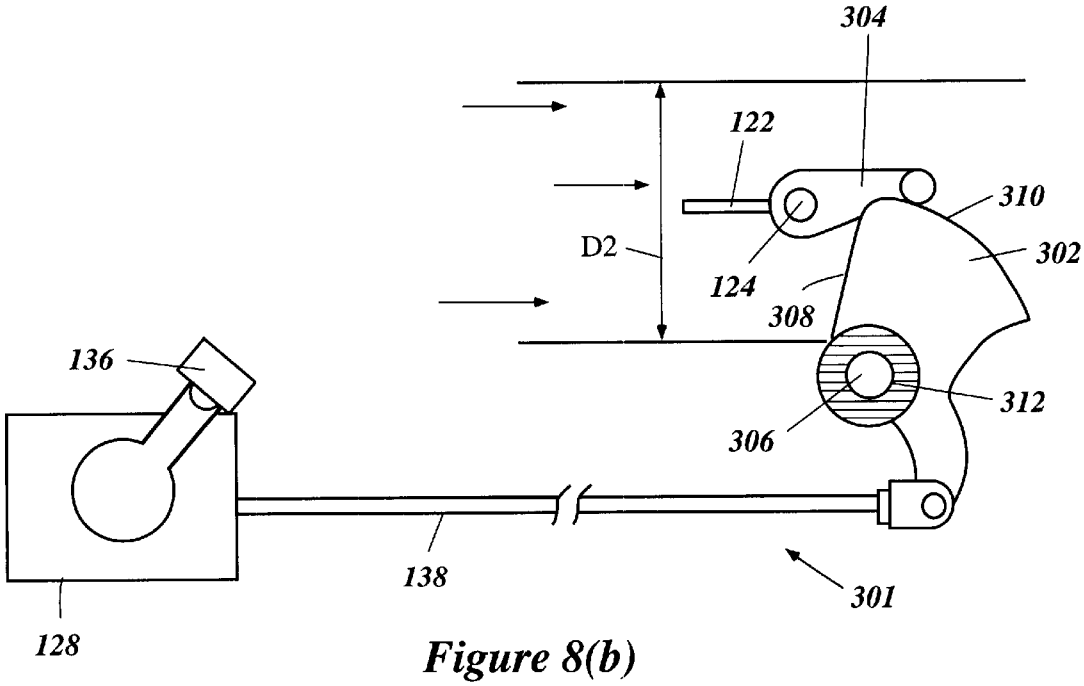

In the control system 300, a throttle valve actuation mechanism 301 includes a cam 302 and a cam follower 304 that replace the throttle valve actuation mechanism 126 of the previously described embodiment. As shown in FIGS. 8(*a*) and 8(*b*), the cam 302 is operated by the controller 128 through the throttle cable 138. The cam 302 pivots about an axis of a camshaft 306. The cam follower 304 is affixed to the valve shaft 124 of the throttle valve 122. The cam follower 304 follows two surfaces 308, 310 of the cam 310. A cam position sensor 312 is affixed to the camshaft 306 rather than to the valve shaft 124 to detect a cam angular position. In the control system 300, the ECU 150 controls the fuel amount based upon a signal of the cam position sensor 312.

As illustrated in FIGS. 8(*a*) and 8(*b*), the fuel injection quantities are controlled in accordance with the intake air pressure and the engine speed until the intake air pressure becomes approximately constant by opening the throttle valve 122 in response to the operation of the throttle operating lever 136. When the cam follower 304 follows the surface 308 (see FIG. 8(*a*)), the throttle valve position linearly increases as shown in the lower graph of FIG. 9, which illustrates the relationship between throttle position (vertical axis) and cam angular position (horizontal axis). When the cam follower 304 traverses from the surface 308 to the surface 310 and follows the surface 310 (see FIG. 8(*b*)), the throttle valve position neither increases nor decreases. That is, the throttle valve 122 reaches the fully open position when the cam follower 304 reaches the surface 310 of the cam 302.

Figure 9:
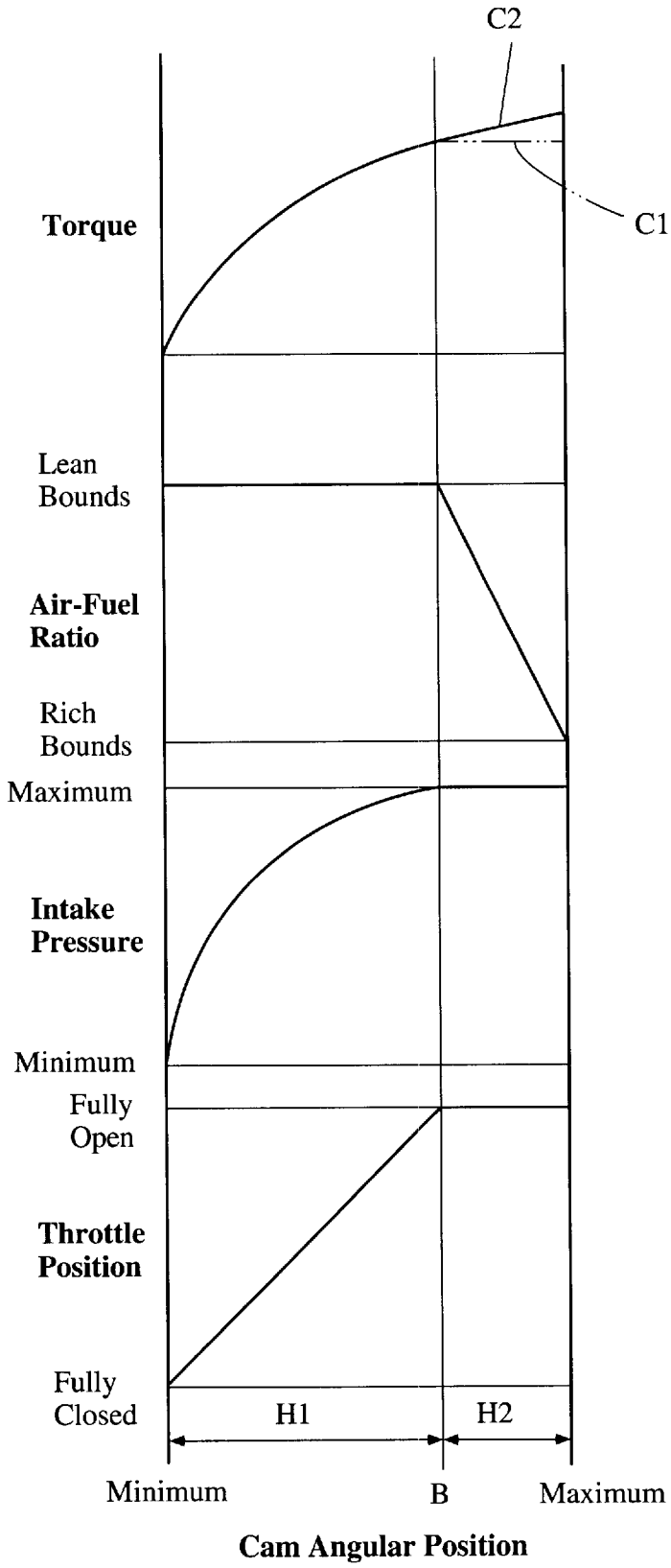
FIG. 9 is a graphical illustration of relationships of throttle valve positions (lowermost graph), intake pressures (next to lowermost graph), air-fuel ratios (next to uppermost graph) and output torque (uppermost graph) versus cam positions.
Figure 11:
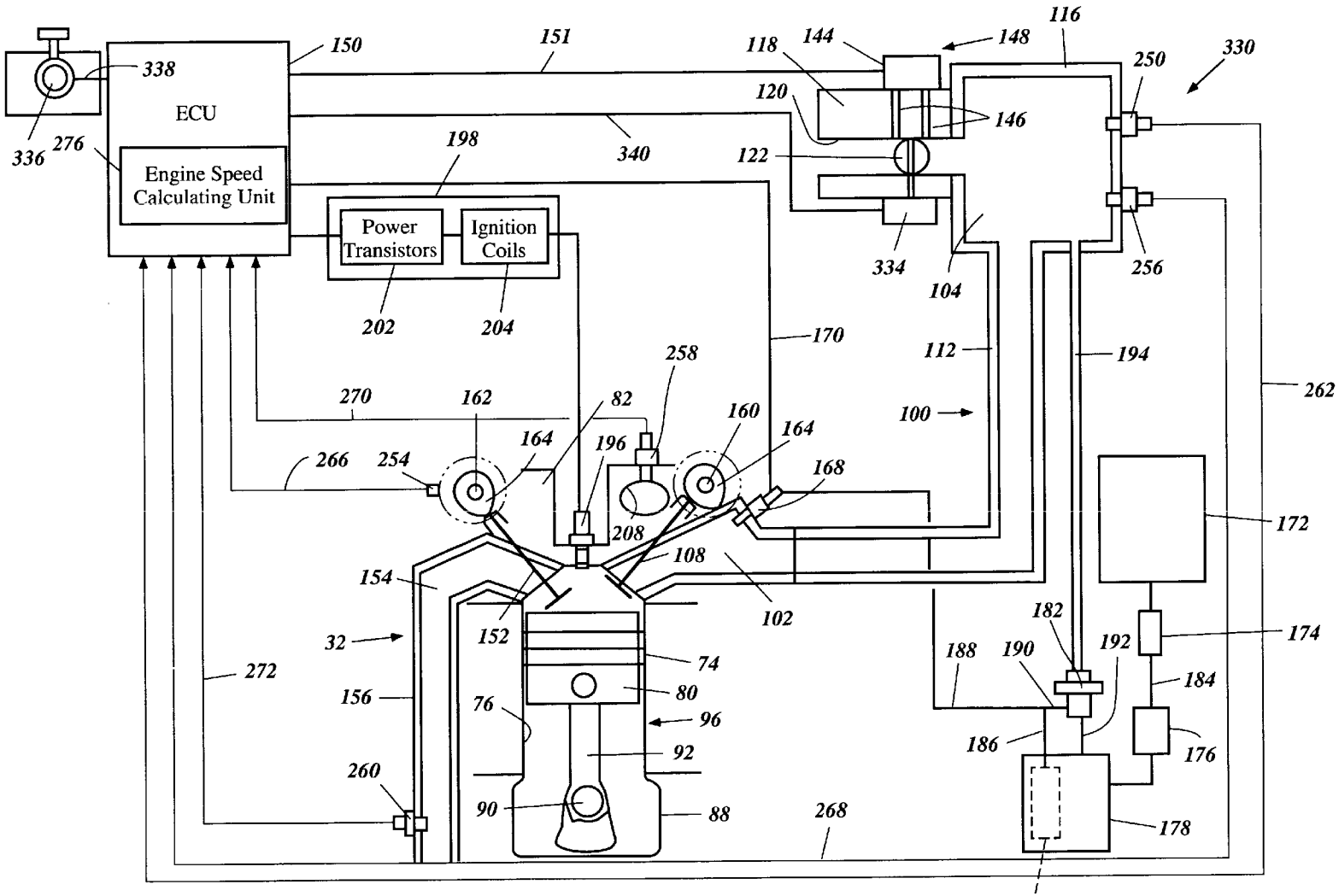
FIG. 11 is a schematic view of a control system in accordance with an alternative embodiment.

The angular position of the cam 302 when the throttle valve position reaches the fully open position is indicated by the reference symbol B in FIG. 9. A first range H1 comprises a range of values of the cam angular position before the throttle valve 122 reaches the fully open position corresponding to the cam angular position B. In the first range H1, the engine is operated with an air-fuel ratio below the lean limit until the intake air volume reaches a value that is approximately a maximum value.

After the throttle valve 122 is fully open at the cam angular position B, the cam 302 continues to rotate through a second range H2 that comprises cam angular position values greater than the value B. Although the cam 302 still rotates in the range H2, the position of the throttle valve 122 does not change. The range H2 in which the throttle valve position does not change when the cam position changes, can be determined at the designer's option.

After the throttle value 122 is fully open or after the intake air pressure increases to a maximum pressure even if the throttle valve 122 is not fully open, the fuel injection quantities are controlled to be rich in accordance with the cam angular position and the engine speed in the range H2, as illustrated by the middle two graphs in FIG. 9. When the intake air volume reaches approximately the maximum volume, the air-fuel ratio is gradually changed to be rich by increasing the fuel injection quantity as illustrated by the next to the uppermost graph in FIG. 9. This causes the engine to be driven with a decreasing air-fuel ratio. As illustrated by an uppermost graph in FIG. 9, in the range H2, the engine has a torque illustrated by a solid curve C2 that is greater than the torque that it would otherwise have in the range H2, as illustrated by a phantom line C1.

As illustrated in FIG. 10(*a*), the injection duration for this alternative embodiment is determined by selecting a injection duration primary value from a main map D1, which is indexed by engine speed and air intake pressure, and by selecting an injection duration correction value from a correction (e.g., adjustment) map D2, which is indexed by engine speed and cam angular position. The correction value is added to the primary value to generate an adjusted injection duration value. When the engine speed is low, the cam angular position is used to used to correct the injection duration to control the torque even at small throttle opening positions.

As shown in FIGS. 8(*a*) and 8(*b*), the air inlet passage 120 has an inner diameter D2 that is determined to provide a required maximum volume of air for the engine 32. The volume of air is easily controlled by varying the position of the throttle value 122 in accordance with the foregoing description.

In FIG. 10(*b*), a main map F1 is used by the ECU 150 to select a primary ignition timing value in response to engine speed and air intake pressure, and a correction map F2 is used by the ECU 150 to select an ignition timing correction value in response to engine speed and cam angular position.

In FIG. 10(*c*), a main map T1 is used by the ECU 150 to select a primary target air-fuel ratio in response to engine speed and air intake pressure, and a correction map T2 is used by the ECU 150 to select a target air-fuel ratio correction value in response to engine speed and cam angular position. As in the previously described embodiment, the ECU 150 uses air-fuel feedback to adjust the air-fuel ratio to achieve the target air-fuel ratio.

A further alternative embodiment of a control system 330 is illustrated in FIGS. 11–14. The components, units, devices and matters that have already been described above will be assigned with the same reference numerals and symbols and will not be described further.

Figure 12A:
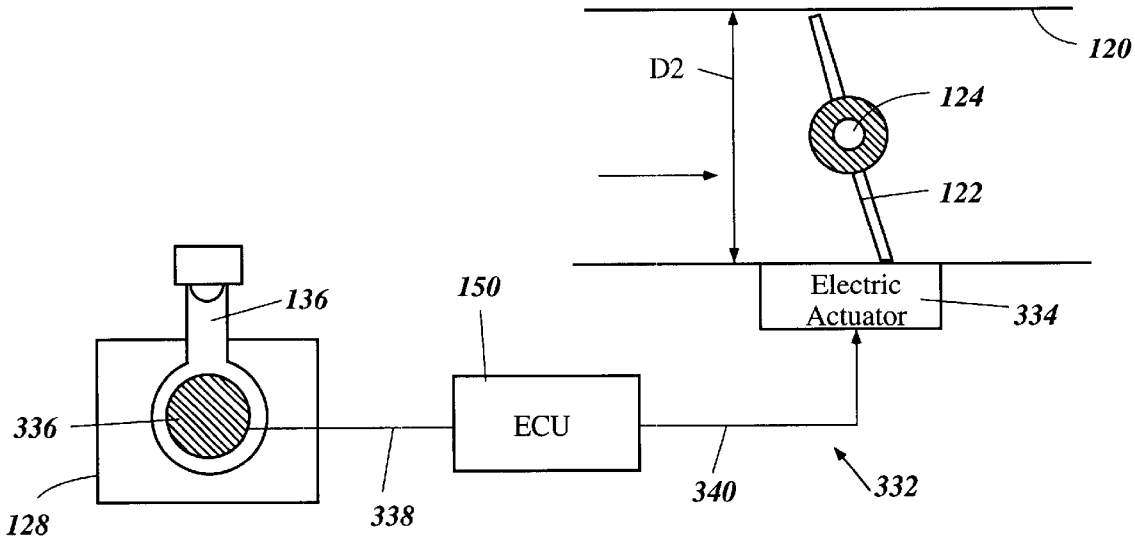
FIGS. 12(*a*) and 12(*b*) are schematic views of an alternative throttle valve actuation mechanism for the control system of FIG. 11 wherein an electrical actuator of the throttle valve is electrically coupled to a controller, and wherein FIG. 12(*a*) illustrates the throttle valve in a fully closed position and FIG. 12(*b*) illustrates the throttle valve is in a fully open position.
Figure 12B:
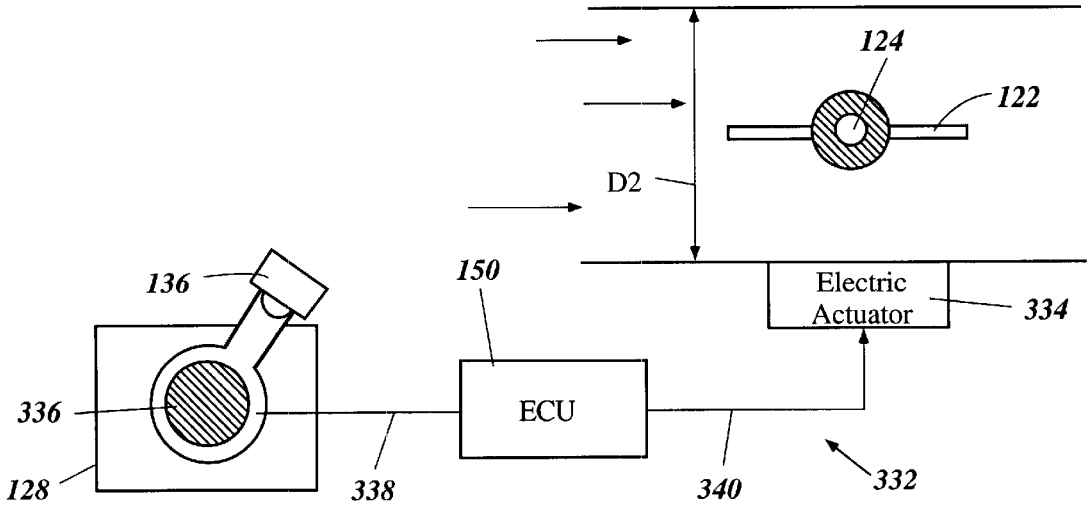

In this further alternative embodiment, a throttle valve actuation mechanism 332 includes an electrical linkage that replaces the throttle valve actuation mechanisms 126, 301 of the previously described embodiments. For example, as schematically illustrated in FIGS. 12(*a*) and 12(*b*), the throttle valve actuation mechanism 332 includes an electrical actuator 334 that advantageously comprises an electric motor coupled to the throttle valve shaft 124. A lever position sensor 336 is located at the throttle control lever 136 of the controller 128 to sense a position of the throttle control lever 136 when the lever 136 is moved by an operator. The sensed lever position is transmitted to the ECU 150 via a signal line 338. The ECU 150 controls the electrical actuator 334 via a control line 340. Although illustrated as hardwired connections, it should be understood that the sensor signal and the control signal can be communicated by other ways such as, for example, by radio waves or optical transmissions. In accordance with this embodiment, the ECU 150 controls the fuel injection quantities based upon the signal from the lever position sensor 336. In this embodiment, the electrical actuator 334 forms a first actuator and the throttle control lever 136 forms a second actuator.

The throttle valve 122 is controlled by the electrical actuator 334 to move from a fully closed position (FIG. 12(*a*)) to a fully open position (FIG. 12(*b*)) to control the volume of intake air. As illustrated by a lowermost graph in FIG. 13, the ECU 150 is configured (e.g., programmed) to activate the electrical actuator 334 in response to the angular position of throttle control lever 136 (e.g., the throttle control lever position). During a first range of operation of the throttle control lever 136 (e.g., a range H1), the throttle valve position changes linearly in response to the throttle control lever position until the throttle control lever 136 reaches a position B and the throttle valve 122 is in a fully open position. As illustrated by a next to lowermost graph in FIG. 13, the air intake pressure increases responsive to the increased opening of the throttle valve 122.

After the throttle valve 128 reaches the fully open position corresponding to the position B of the throttle control lever 136, further increases in the position of the throttle control lever 136 in a range H2 do not affect the position of the throttle valve 122 or affect the air intake pressure. The range H2 in which the throttle valve position does not change when the cam position changes can be determined at the designer's option.

As illustrated in a next to uppermost graph in FIG. 13, in the first range H1, the engine is operated with an air-fuel ratio below the lean limit until the intake air volume reaches a value that is approximately a maximum value when the throttle control lever 136 reaches the position B.

Figure 13:
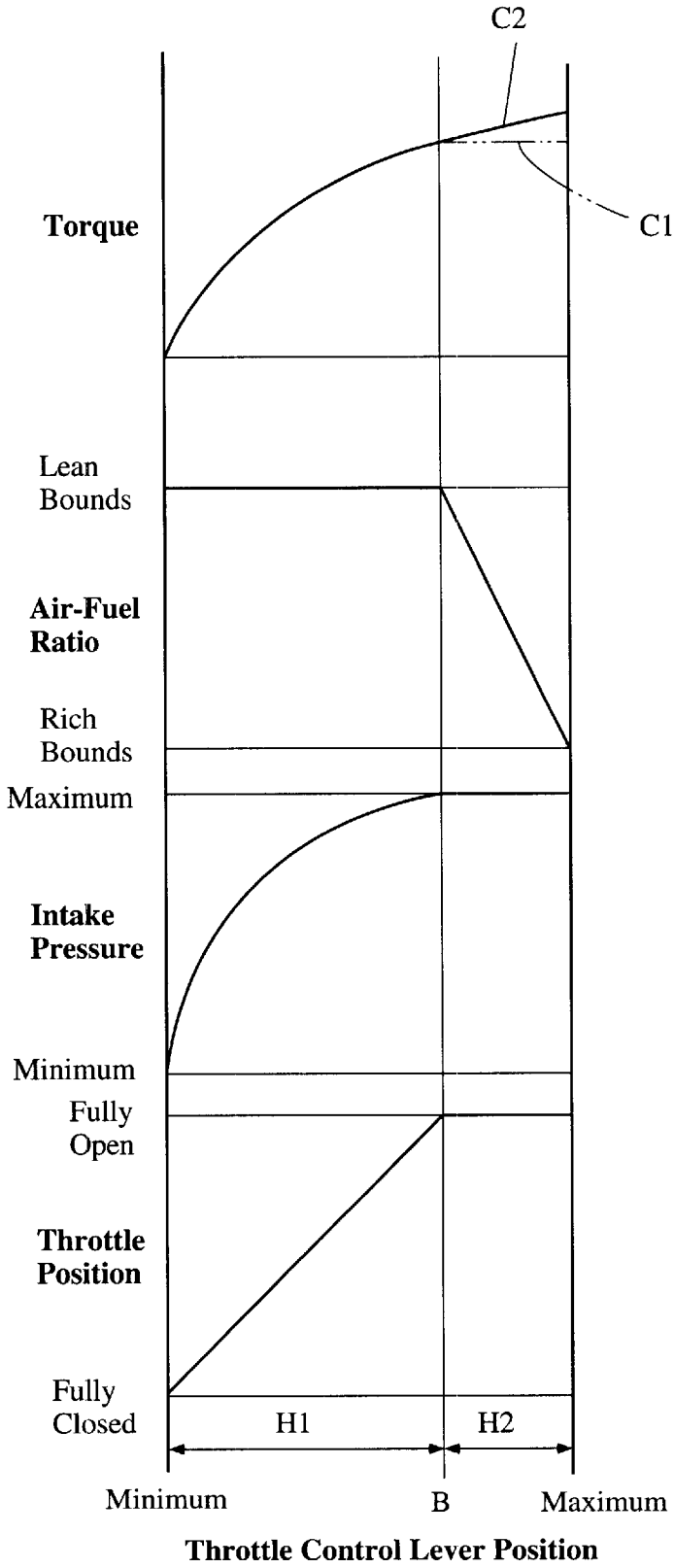
FIG. 13 is a graphical illustration of relationships of throttle valve positions (lowermost graph), intake pressures (next to lowermost graph), air-fuel ratios (next to uppermost graph) and output torque (uppermost graph) versus throttle control lever positions.

After the throttle value 122 is fully open or after the intake air pressure increases to a maximum pressure even if the throttle valve 122 is not fully open, the fuel injection quantities are controlled to be very rich in accordance with the cam angular position and the engine speed in the range H2, as illustrated by the next to the uppermost graph in FIG. 13. When the intake air volume reaches approximately the maximum volume, the air-fuel ratio is gradually changed to be rich by increasing the fuel injection quantity as illustrated by the next to the uppermost graph in FIG. 13. This causes the engine to be driven with a decreasing air-fuel ratio. As illustrated by the uppermost graph in FIG. 13, in the range H2, the engine operating in accordance with this embodiment has a torque illustrated by a solid curve C2 that is greater than the torque that it would otherwise have in the range H2, as illustrated by a phantom line C1.

As illustrated in FIG. 14(*a*), the injection duration for this alternative embodiment is determined by selecting a injection duration primary value from a main map D1, which is indexed by engine speed and air intake pressure, and by selecting an injection duration correction value from a correction (e.g., adjustment) map D2, which is indexed by engine speed and throttle control lever position. The correction value is added to the primary value to generate an adjusted injection duration value. When the engine speed is low, the throttle control lever position is used to used to correct the injection duration to control the torque even at small throttle opening positions.

As shown in FIGS. 12(*a*) and 12(*b*), the air inlet passage 120 has an inner diameter D2 that is determined to provide a required maximum volume of air for the engine 32. The volume of air is easily controlled by varying the position of the throttle value 122 in accordance with the foregoing description.

In FIG. 14(*b*), a main map F1 is used by the ECU 150 to select an ignition timing primary value in response to engine speed and air intake pressure, and a correction map F2 is used by the ECU 150 to select an ignition timing correction value in response to engine speed and throttle control lever position.

In FIG. 14(*c*), a main map T1 is used by the ECU 150 to select a target air-fuel ratio primary value in response to engine speed and air intake pressure, and a correction map T2 is used by the ECU 150 to select a target air-fuel ratio correction value in response to engine speed and throttle control lever position. As in the previously described embodiments, the ECU 150 uses air-fuel feedback to adjust the air-fuel ratio to achieve the target air-fuel ratio.

In selected alternative arrangements, the ECU 150 can previously store the maximum pressure of the intake pressure rather than the throttle valve position A FIG. 4) or the cam angular position B (FIG. 9) or the control lever position B FIG. 13). The ECU 150 can use the stored value to determine when the throttle valve, the cam or the control lever reaches the position A or B, respectively, which corresponds to a maximum air intake pressure. Alternatively, in the embodiments of FIGS. 7–10 and FIGS. 11–14, the ECU 150 can advantageously use the fully open position of the throttle valve to determine when the cam or the control lever reaches the position B.

The foregoing description is that of preferred controls having certain features, aspects and advantages in accordance with the present invention. Various changes and modifications also may be made to the above-described controls without departing from the spirit and scope of the invention, as defined by the claims.

What is claimed is:

1. An internal combustion engine for a marine drive, the engine comprising an engine body; a first movable member movable relative to the engine body, the engine body and the movable member together defining a combustion chamber; a second movable member movable in connection with the first movable member; an air intake device configured to introduce air to the combustion chamber; an air regulator in the air intake device to regulate an amount of the air; a first actuator to actuate the air regulator; a fuel injector configured to spray fuel for combustion in the combustion chamber; a first sensor configured to detect an intake pressure in the intake device; a second sensor configured to detect a state of at least one of the air regulator or the first actuator; a third sensor configured to detect an engine speed in relation to the second movable member; and a control device configured to control an amount of the fuel relative to the amount of the air, the control device controlling the amount of the fuel based upon a signal of the third sensor and a signal of the first sensor in a first actuation range of the first actuator in which the intake pressure is variable, the control device controlling the amount of the fuel based upon a signal of the third sensor and the signal of the second sensor in a second actuation range of the first actuator in which the intake pressure is invariable.

2. The engine as set forth in claim 1, wherein the first actuator of the air regulator is operable via a mechanical linkage.

3. The engine as set forth in claim 2, further comprising a second actuator directly operable by an operator, the first actuator and the second actuator being connected via the mechanical linkage.

4. The engine as set forth in claim 2, wherein the first actuator comprises a cam coupled to the mechanical linkage and cam follower coupled to the air regulator, and wherein the cam has a first surface in contact with the cam follower when the cam is operated in the first actuation region and has a second surface in contact with the cam follower when the cam is operated in the second actuation region, the state of the air regulator being responsive to movement of the cam in the first actuation region and the state of the air regulator remaining substantially unresponsive to movement of the cam in the second actuation region.

5. The engine as set forth in claim 4, wherein the second sensor detects a position of the cam.

6. The engine as set forth in claim 1, wherein the first actuator is a power control selector operable over first and second ranges of power settings, the first actuator coupled via an electrical linkage to a second actuator coupled to the air regulator, the second actuator responsive to operation of the power control selector over the first range of settings to change the state of the air regulator, the second actuator being non-responsive to operation of the power control selector over the second range of settings such that the state of the air regulator does not change, and wherein the second sensor senses the power settings of the power control selector.

7. The engine as set forth in claim 6, wherein the second actuator is an electrical motor.

8. The engine as set forth in claim 1, wherein the control device controls the amount of the fuel so that an air-fuel ratio is leaner than the stoichiometric air-fuel ratio generally in the first actuation range of the first actuator.

9. The engine as set forth in claim 8, wherein the control device controls the amount of the fuel in the second actuation range of the first actuator so that an air-fuel ratio is at least equal to the stoichiometric air-fuel ratio.

10. The engine as set forth in claim 1, wherein the control device controls the amount of the fuel in the second actuation range of the first actuator so that an air-fuel ratio is at least equal to the stoichiometric air-fuel ratio.

11. The engine as set forth in claim 1, wherein the intake pressure varies in a range below a maximum pressure when the first actuator is operated in the first actuation range and is approximately equal to the maximum pressure when the first actuator is operated in the second actuation range.

12. The engine as set forth in claim 1, wherein when the first actuator is movable in the first actuation range, the air regulator has a state responsive to the first actuator until the first actuator moves to a position where the air regulator reaches a state of maximum air flow, wherein the air regulator remains in the state of maximum air flow when the first actuator moves in the second actuation range, and wherein the second sensor detects the position of the first actuator.

13. The engine as set forth in claim 1, wherein the control device adjusts the amount of the fuel based upon the signal of the second sensor in the first actuation range.

14. The engine as set forth in claim 1, wherein the air regulator is a throttle valve.

15. A control system for a marine engine, the engine having an air intake device configured to introduce air to a combustion chamber of the engine, the intake device incorporating an air regulator that regulates an amount of the air, and a fuel injector configured to spray fuel for combustion in the combustion chamber, the control system comprising a first actuator that actuates the air regulator; a first sensor configured to detect an intake pressure in the intake device; a second sensor configured to detect a state of at least one of the air regulator or the first actuator; a third sensor configured to detect an engine speed of the engine; and a control device configured to control an amount of the fuel relative to the amount of the air, the control device controlling the amount of the fuel based upon a signal of the third sensor and a signal of the first sensor in a first actuation range of the first actuator in which the intake pressure is variable, the control device controlling the amount of the fuel based upon the signal of the third sensor and a signal of the second sensor in a second actuation range of the first actuator in which the intake pressure is invariable.

16. The control system as set forth in claim 15, wherein the first actuator is coupled to the air regulator via a mechanical linkage.

17. The control system as set forth in claim 15, wherein the first actuator is coupled to the air regulator via an electrical linkage.

18. The control system as set forth in claim 15, further comprising a second actuator coupled to the air regulator, the control device controlling the second actuator in response to a state of the first actuator such that the state of the air regulator changes in response to operation of the first actuator in the first actuation range and the state of the air regulator remains substantially constant in response to operation of the first actuator in the second actuation range.

19. The control system as set forth in claim 18, wherein the second sensor detects the state of the first actuator.

20. The control system as set forth in claim 18, wherein the first actuator comprises a cam that moves responsive to a control input and the second actuator comprises a cam follower that changes the state of the air regulator when the cam is operated in the first actuation range and that maintains an approximately constant state of the air regulator when the cam is operated in the second actuation range.

21. The control system as set forth in claim 18, wherein the first actuator comprises a power control selector operable over first and second ranges of power settings, the first actuator coupled via an electrical linkage to a second actuator coupled to the air regulator, the second actuator responsive to operation of the power control selector over the first range of settings to change the state of the air regulator, the second actuator being non-responsive to operation of the power control selector over the second range of settings such that the state of the air regulator does not change, and wherein the second sensor senses the power settings of the power control selector.

22. The control system as set forth in claim 21, wherein the second actuator is an electrical motor.

23. The control system as set forth in claim 15, wherein the control device controls the amount of the fuel so that an air-fuel ratio is leaner than the stoichiometric air-fuel ratio in the first actuation range of the actuator.

24. The control system as set forth in claim 15, wherein the control device controls the amount of the fuel so that an air-fuel ratio is at least equal to the stoichiometric air-fuel ratio in the second actuation range of the first actuator.

25. The control system as set forth in claim 15, wherein the intake pressure is less than a maximum intake pressure in the first actuation range of the first actuator and is approximately equal to the maximum pressure in the second actuation range of the first actuator.

26. The control system as set forth in claim 15, wherein the state of first actuator is variable after the air regulator reaches a state of maximum air flow, and wherein the second sensor detects the state of the first actuator.

27. The control system as set forth in claim 15, wherein the control device adjusts the amount of the fuel based upon the signal of the second sensor in the first actuation range.

28. The control system as set forth in claim 15, wherein the air regulator is a throttle valve.

29. A control method for controlling a marine engine comprising sensing an intake pressure of an air intake device, sensing either a state of an air regulator of the intake device or a state of a first actuator that actuates the air regulator, sensing an engine speed of the engine, controlling an amount of fuel injected by a fuel injector relative to an amount of air introduced through the intake device based upon the engine speed and the intake pressure in a first actuation range of the first actuator in which the intake pressure is variable, and controlling the amount of the fuel based upon the engine speed and the sensed state of the air regulator or the sensed state of the first actuator in a second actuation range of the first actuator in which the intake pressure is invariable.

30. The control method as set forth in claim 29, wherein the amount of the fuel in the first actuation range of the first actuator is sufficiently small that an air-fuel ratio in the first actuation range is leaner than the stoichiometric air-fuel ratio.

31. The control method as set forth in claim 30, wherein the amount of the fuel in the second actuation range of the first actuator is sufficiently large that an air-fuel ratio in the second actuation range is at least equal to the stoichiometric air-fuel ratio.

32. The control method as set forth in claim 29, wherein the amount of the fuel in the second actuation range of the first actuator is sufficiently large that an air-fuel ratio in the second actuation range is at least equal to the stoichiometric air-fuel ratio.

33. The control method as set forth in claim 29 additionally comprising adjusting the amount of the fuel based upon the signal of the second sensor in the first actuation range.

34. The control method as set forth in claim 28, wherein the air regulator is a throttle valve.

35. An engine control system for an internal combustion engine for a marine drive that comprises at least one combustion chamber that receives air-fuel charges, the engine operating at a variable engine speed in response to ignition of the air-fuel charges, the engine further comprising an air intake device that introduces air to the combustion chamber, the air intake device incorporating an air regulator that regulates an amount of air introduced to the combustion chamber by the air intake device, the engine further comprising a fuel injector that introduces fuel to the combustion chamber, the engine control system comprising a first sensor that detects an intake pressure in the air intake device and generates a first sensor signal responsive to the intake pressure; a second sensor that detects a state of the air regulator and generates a second sensor signal responsive to the state of the air regulator; a third sensor that detects the engine speed and generates a third signal responsive to the engine speed; and a control device that operates in a first mode of operation when the intake pressure is varying to control an amount of fuel introduced by the fuel injector in response to the third sensor signal and the first sensor signal and that operates in a second mode of operation when the intake pressure is not varying to control the amount of fuel introduced by the fuel injector in response to the third sensor signal and the second sensor signal.

36. The engine control system of claim 35, wherein the air regulator is a throttle valve and wherein the second sensor signal is responsive to a position of the throttle valve in the air intake device.

37. The engine control system of claim 36, wherein the position of the throttle valve varies over a first range in the first mode of operation from a minimal opening of the throttle valve to an intermediate opening of the throttle valve, and wherein the position of the throttle valve varies over a second range in the second mode of operation from the intermediate opening of the throttle valve to a maximum opening of the throttle valve.

38. An engine control system for an internal combustion engine for a marine drive that comprises at least one combustion chamber that receives air-fuel charges, the engine operating at a variable engine speed in response to ignition of the air-fuel charges, the engine further comprising an air intake device that introduces air to the combustion chamber, the air intake device incorporating an air regulator that regulates an amount of air introduced to the combustion chamber by the air intake device, the air regulator having a variable state responsive to an actuator, the engine further comprising a fuel injector that introduces fuel to the combustion chamber, the engine control system comprising a first sensor that detects an intake pressure in the air intake device and generates a first sensor signal responsive to the intake pressure; a second sensor that detects a state of the actuator of the air regulator and generates a second sensor signal responsive to the state of the actuator; a third sensor that detects the engine speed and generates a third signal responsive to the engine speed; and a control device that operates in a first mode of operation when the intake pressure is varying to control an amount of fuel introduced by the fuel injector in response to the third sensor signal and the first sensor signal and that operates in a second mode of operation when the intake pressure is not varying to control the amount of fuel introduced by the fuel injector in response to the third sensor signal and the second sensor signal.

39. The engine control system of claim 38, wherein the air regulator is a throttle valve and the state of the air regulator is a position in the air intake device that controls the amount of air introduced to the combustion chamber, and wherein the position of the throttle valve varies in response to the state of the actuator during the first mode of operation and the position of the throttle valve does not vary in response to the state of the actuator during the second mode of operation.

40. The engine control system of claim 38, wherein the actuator is a cam having a first surface and a second surface, and wherein the air regulator is coupled to the cam via a cam follower that follows the first surface during the first mode of operation and that follows the second surface during the second mode of operation.

41. The engine control system of claim 40, wherein the first surface varies in distance from a rotational axis of the cam and the second surface is at a substantially constant distance from the rotational axis of the cam.

42. The engine control system of claim 38, wherein the actuator is a power control selector and the signal responsive to the state of the actuator is responsive to a power setting of the power control selector, and wherein the air regulator is responsive to changes in the power setting in the first mode of operation and the air regulator is not responsive to changes in the power setting in the second mode of operation.

43. The engine control system of claim 42, wherein the air regulator is controlled by an electrical motor, and wherein the electrical motor operates to control the air regulator in response to changes in the power settings in the first mode of operation, and the electrical motor maintains the air regulator in a substantially constant state in the second mode of operation.

44. The engine control system of claim 43, wherein the control device receives the signal responsive to the state of the actuator and generates control signals to the electrical motor to cause the electrical motor to control the air regulator in response to the state of the actuator in the first mode of operation and generates control signals to the electrical motor to cause the electrical motor to maintain the substantially constant state of the air regulator in the second mode of operation.

* * * * *